US006477947B2

(12) United States Patent
Takahashi

(10) Patent No.: US 6,477,947 B2
(45) Date of Patent: Nov. 12, 2002

(54) STENCIL PRINTING APPARATUS

(75) Inventor: Yasuhiro Takahashi, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 38 days.

(21) Appl. No.: 09/780,605

(22) Filed: Feb. 12, 2001

(65) Prior Publication Data

US 2001/0015143 A1 Aug. 23, 2001

(30) Foreign Application Priority Data

Feb. 14, 2000 (JP) ..... 2000-035419

(51) Int. Cl.[7] ..... B41C 1/14
(52) U.S. Cl. ..... 101/128.4; 101/116
(58) Field of Search ..... 101/115, 116, 101/128.4, 129, 114

(56) References Cited

U.S. PATENT DOCUMENTS 5,048,416 A * 9/1991 Iijima ..... 101/115
5,375,516 A * 12/1994 Hasegawa ..... 101/115
6,334,387 B1 * 1/2002 Motoe ..... 101/116

FOREIGN PATENT DOCUMENTS

EP 1086824 A1 * 3/2001 ..... B41C/1/055

OTHER PUBLICATIONS

Patent Abstracts of Japan, vol. 1995, No. 05, Jun. 30, 1995 & JP07 040643 A (Tohoku Ricoh Co., Ltd.), Feb. 10, 1995.

* cited by examiner

*Primary Examiner*—Ren Yan
(74) *Attorney, Agent, or Firm*—Kanesaka & Takeuchi

(57) ABSTRACT

To pertinently control perforation and transfer (setting) of a stencil sheet in correspondence with each of plural printing drums, perforated stencil sheet are set to plural printing drums byt moving single stencil making unit, and a position of the stencil making unit is detected by position sensors and a shield plate. Then, printing drum information of ink color supplied to the respective printing drums is detected by a printing drum information detecting device with regard to respective printing drums, and the stencil making unit is made to be standby as it is at a position of setting drum to which the stencil making unit has been transferred finally after finishing to transfer stencil sheet to the respective printing drums. At a successive stencil making operation, stencil making instruction information expediting perforation to an operator is sent from the printing drum at standby position to be displayed on a displaying device.

3 Claims, 26 Drawing Sheets

STENCIL PRINTING APPARATUS

BACKGROUND OF THE INVENTION AND RELATED ART STATEMENT

The present invention relates to a stencil printing machine having a stencil making apparatus for stencil making stencil sheet set to a printing drum, particularly to a stencil printing machine for supplying stencil sheet perforated by a single stencil making apparatus to a plurality of printing drums.

FIG. 26 is a side view showing a conventional stencil printing machine. Stencil sheet S to be perforated is wound in a shape of a roll and is rotatably supported. Stencil sheet S drawn from a stencil sheet S in the shape of a roll is constituted by a shape of a continuous strip. The drawn stencil sheet S is sandwiched between a thermal head 150 and a platen roller 151.

Stencil sheet S is thermally perforated by the thermal head 150. During a time period in which stencil sheet S is thermally perforated, stencil sheet S is transferred while being brought into contact with the thermal head 150 by rotation of the platen roller 151. Thereafter, stencil sheet S is contained in a store box 152 until thermal perforation of one block has been finished by the thermal head 150. Stencil sheet S is contained in the store box 152 by stopping upper and lower load rollers 153 and 154 disposed on an upper side of the store box 152 while sandwiching stencil sheet S and feeding stencil sheet S only by the platen roller 151. Further, a common transfer path 155 is arranged on a front side of the store box 152. The common transfer path 155 is provided with cutter means 156 for cutting perforated stencil sheet S by an amount of one block.

After finishing the thermal perforation, the thermal head 150 is moved in an upper direction to thereby release the thermal head 150 from sandwiching stencil sheet S along with the platen roller 151. Stencil sheet S which has been thermally perforated is transferred to printing drums 157 by the upper and lower load rollers 153 and 154 via the common transfer path 155.

Meanwhile, according to the stencil making apparatus shown by FIG. 26, perforated stencil sheet S is transferred to two of the printing drums 157. Therefore, the stencil making apparatus is provided with respective transfer paths 158 for transferring stencil sheet S to the respective printing drums 157 after transferring through the common transfer path 155 and a switch mechanism 160 for selectively switching the transfer paths 158 such that the common transfer path 155 communicates with either of the transfer paths 158.

The respective transfer path 158 transfers stencil sheet S by a plurality of transfer roller pairs 159 while guiding stencil sheet S between upper and lower guide plates 158*a* and 158*b*. The switch mechanism 160 is arranged between the common transfer path 155 and the respective transfer paths 158 and is provided with a shunt transfer path 162 movable by a solenoid 161. The shunt transfer path 162 moved by the solenoid 161 opens communication from the common transfer path 165 to one of the transfer paths 158 or from the common transfer path 155 to other of the transfer paths 158.

A front end of stencil sheet S transferred to the one transfer path 158 or the other transfer path 158 is pinched by a clamp plate 163 provided to the printing drum 157, fixed to the printing drum 157 and thereafter, transferred by rotation of the printing drum 157 and is wound on a peripheral face of the printing drum 157. Further, print sheet S is cut by an amount of one block by the cutter means 156 while being transferred or while being set to the printing drum 157.

Further, with regard to the stencil printing machine shown by FIG. 26, a portion of a peripheral wall 164 of the printing drum 157 is ink-permeable. There is provided ink supplying means, not illustrated, for supplying ink to an inner face of the peripheral wall 164 at an inner portion of the printing drum 157. There is provided pressing means, not illustrated, for pressing print sheet to the printing drum 157 on a lower side of the printing drum 157. The stencil printing machine rotates the printing drum 157, feeds print sheet to between the printing drum 157 and the pressing means at predetermined timings and presses the print sheet to an image portion of stencil sheet S mounted to the printing drum 157. Print ink supplied from inside of the printing drum 157 permeates through the peripheral wall 164 of the printing drum 157 and transcribed from a perforated portion of stencil sheet S onto print sheet to thereby form an image.

However, according to the above-described conventional stencil printing machine, when stencil sheet S perforated by the stencil making apparatus is transferred to the printing drum 157, there is needed the long transfer path 158 particularly for transferring stencil sheet S to the printing drum 157 disposed remote from a position provided with the stencil making apparatus per se. Therefore, a control in transferring the stencil sheet S at the respective transfer paths 158, differs thereby. That is, for example, it is conceivable that a drive timing of the cutter means 156, a switch timing of the switch mechanism 160 (a time period of switching to the longer one of the transfer paths 158 is prolonged) and drive time periods and drive timings of the respective transfer roller pairs 159, differ and there poses a problem in which a complicated control is requested by combining these.

Further, when printing drum information of the respective printing drums 157 such as ink color or the like differs, in addition to the fact that the control with regard to the transfer is complicated, further complicated control is needed.

SUMMARY OF THE INVENTION

Hence, in order to resolve the above-described problem, it is an object of the present invention to provide a stencil printing machine capable of pertinently controlling stencil making and transfer (setting) of stencil sheet respectively in correspondence with a plurality of printing drums.

In order to achieve the above-described object, according to an aspect of the present invention, there is provided a stencil printing machine comprising:

- a stencil making unit for stencil making stencil sheet;
- a plurality of printing drums capable of setting the perforated stencil sheet;
- a movement mechanism for moving the stencil making unit to the respective printing drums;
- position detecting means for detecting a position of the stencil making unit;
- printing drum information detecting means for detecting printing drum information with regard to the respective printing drums;
- displaying means for displaying stencil making instruction information for making the stencil making unit execute a stencil making operation; and
- control means for making the displaying means display the stencil making instruction information capable of dealing with the printing drum information, making the stencil making unit execute the stencil making operation based on the stencil making instruction information and making the stencil making unit move.

According to the stencil printing machine of the first aspect of the present invention, in the stencil printing machine having the stencil making apparatus for transferring perforated stencil sheet to the plurality of printing drums, the single stencil making unit is moved and stencil making and setting operation is carried out at the respective printing drums. Further, the position of the stencil making unit is detected, the printing drum information of the respective printing drums is detected and stencil making instruction information is displayed in correspondence with the detection.

Thereby, control of stencil making and setting stencil sheet at the stencil making unit becomes uniform with respect to the printing drums and the control can be simplified. Further the operator is expedited by display of set of the original respectively in correspondence with printing drum information of the plurality of printing drums and therefore, erroneous operation by the operator is eliminated and stencil making operation and transferring (setting) operation of the stencil sheet can be carried out in correspondence with the plurality of printing drums.

Further, according to a second aspect of the present invention, there is provided the stencil printing machine according to the first aspect of the stencil printing machine:

wherein the stencil making unit is constituted to move to an initial position substantially at equal distance from the respective printing drums; and wherein the control means moves the stencil making unit to the initial position after finishing to transfer the stencil sheet to the respective printing drums and makes the displaying means display the stencil making instruction information for expediting the stencil making operation with regard to any of the printing drums in a successive stencil making operation.

According to the stencil printing machine of the second aspect of the present invention, the stencil making unit is moved to an initial position substantially at equal interval from the respective printing drums. And after finishing to transfer (set) stencil sheet to respective printing drums, the stencil making unit is moved to the initial position. Thereby, the movement distance of the stencil making unit can be made uniform with respect to either of the printing drums. And in selecting the respective printing drums, the stencil making unit can be moved swiftly and accordingly, control of moving the stencil making unit can be made simple control with the initial position as a reference.

Further, according to a third aspect of the present invention, there is provided the stencil printing machine according to the first aspect of the stencil printing machine:

wherein control means makes the stencil making unit stay on standby at a position of the printing drum to which the stencil making unit has been finally transferred after finishing to transfer the stencil sheet to the respective printing drums and makes the displaying means display the stencil making instruction information for expediting the stencil making operation with regard to the printing drum disposed at a position at which the stencil making unit is on standby in a successive stencil making operation.

According to the stencil printing machine of the third aspect of the present invention, after finishing to transfer stencil sheet to the respective printing drums, the stencil making unit is made to be on standby at the position of the printing drum to which the stencil making unit has been transferred finally. And at successive stencil making operation, stencil making instruction information for expediting stencil making with regard to the printing drum disposed at the position at which the stencil making unit is on standby, is displayed at the displaying means. Thereby, in carrying out multiple color printing using the respective printing drums, initial stencil making and setting operation is carried out without moving the stencil making unit and accordingly, movement operation of the stencil making unit is restrained without waste and a time period from stencil making operation to initially providing printed print sheet can be shortened.

DETAILED DESCRIPTION OF THE PREFERRED EMBODIMENTS

Figure 1:
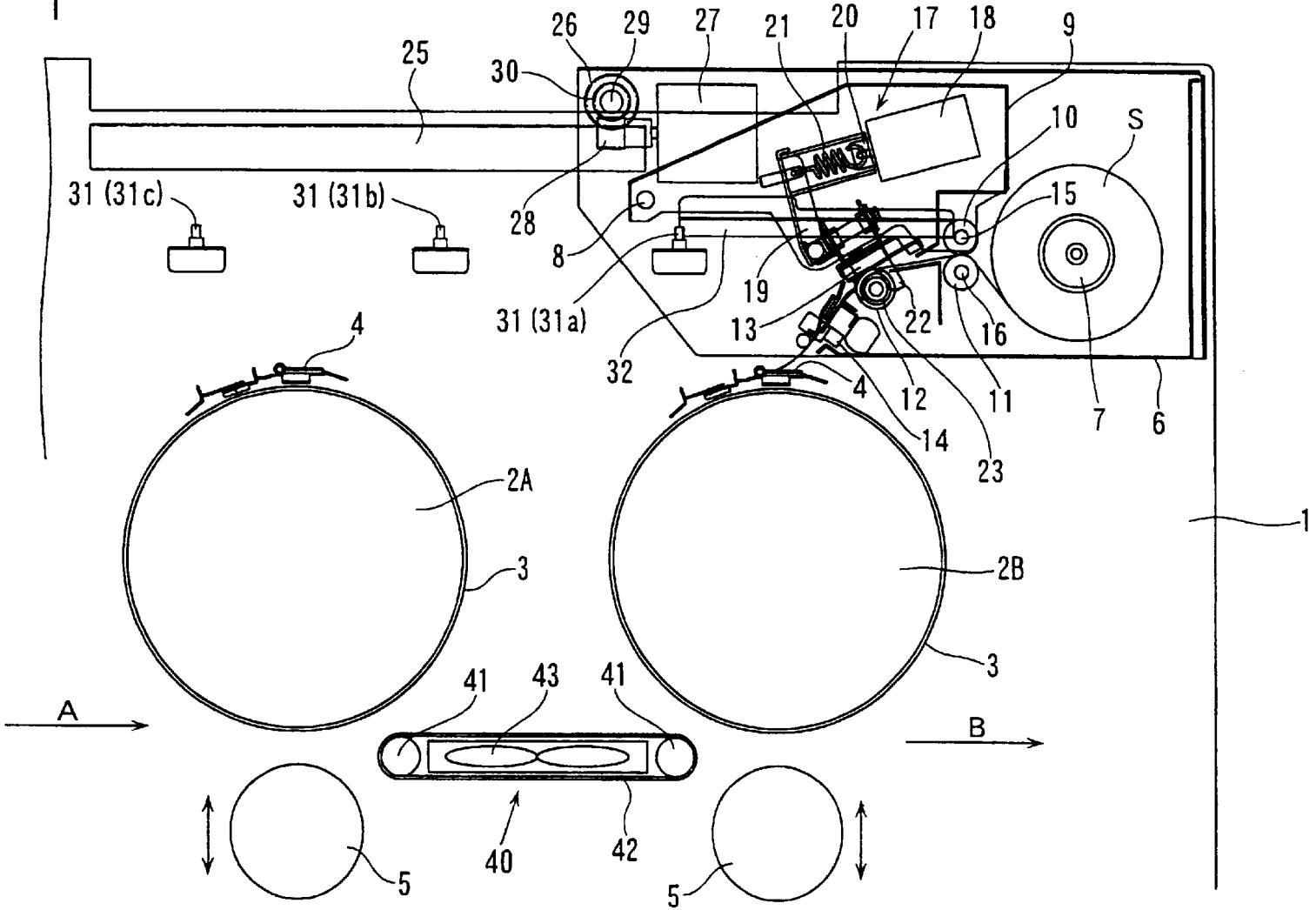
FIG. 1 is a side view showing a first embodiment of a stencil printing machine according to the present invention.
Figure 2:
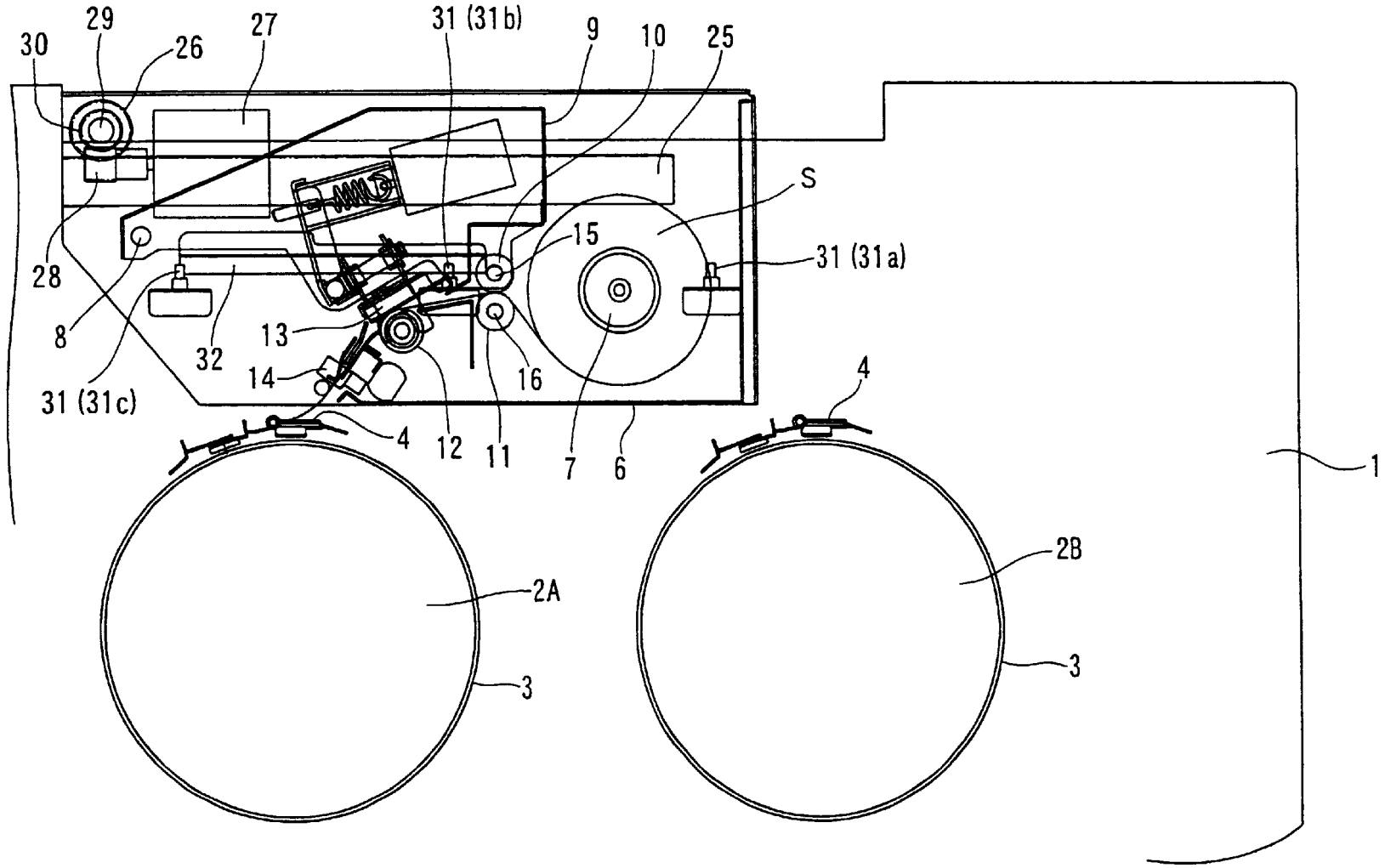
FIG. 2 is a side view showing operation of a stencil making apparatus according to the stencil printing machine.
Figure 3:
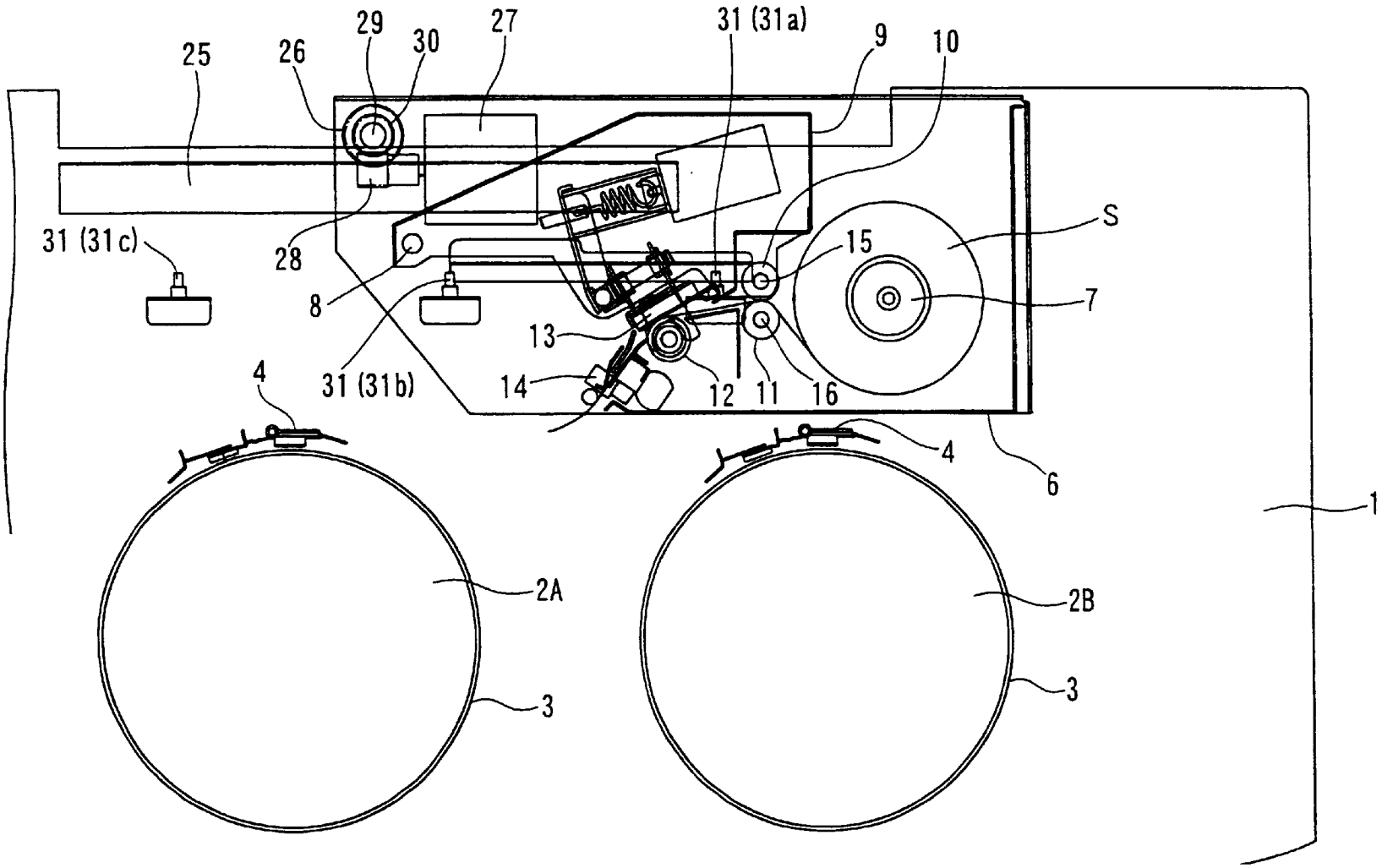
FIG. 3 is a side view showing the operation of the stencil making apparatus according to the stencil printing machine.

A specific explanation will be given of a first embodiment according to the present invention in reference to the drawings as follows. FIG. 1 is a side view showing a first embodiment of a stencil printing machine according to the present invention. FIG. 2 and FIG. 3 are side views showing operation of a stencil making apparatus according to the stencil printing machine.

As shown by FIG. 1, the stencil printing machine according to the first embodiment is provided with a plurality (two in the embodiment) of printing drums 2A and 2B at inside of a machine body 1. The respective printing drums 2A and 2B are arranged such that axis lines of their own are in parallel with each other and horizontal. The printing drums 2A and 2B each is provided with a peripheral wall 3 substantially in a shape of a cylinder at least one portion of which is ink-permeable, a clamp plate 4 as fixing means provided on an outer peripheral face of the peripheral wall 3 and ink supplying means, not illustrated, provided on the inner side of the peripheral wall 3 for supplying ink to an inner peripheral face of the peripheral wall 3. The printing drums 2A and 2B are driven to rotate centering on the axis lines of their own.

Further, on lower sides of the respective printing drums 2A and 2B, there are respectively provided pressing means 5 for pressing print sheet to the printing drums 2A and 2B. As shown by FIG. 1, as the pressing means, there are press rollers capable of being brought into contact with and separated from the printing drums 2A and 2B. Other than these, although not illustrated, there are provided pressure drums having a diameter the same as that of the printing drums 2A and 2B and rotated by being brought into contact with the printing drums 2A and 2B in a state of being wound with print sheet.

Between the respective printing drums 2A and 2B, there is provided transfer means 40 for transferring print sheet printed by the printing drum 2A to the printing drum 2B. According to the transfer means 40, there is reeved a belt 42 in an endless shape around two rollers 41 arranged at vicinities of the respective printing drums 2A and 2B. The belt 42 is circulated by being driven by the rollers 41. Further, between the respective rollers 41, there is provided a suck mechanism 43 such as a fan for sucking print sheet to be transferred and drawing the print sheet to the belt 42.

Further, according to the stencil printing machine, there is provided a single stencil making apparatus for transferring (setting) perforated stencil sheet S to the respective printing drums 2A and 2B. The stencil making apparatus is arranged at a frame 6. The frame 6 is provided with a master holder 7 for rotatably containing stencil sheet S wound in a shape of a roll. Stencil sheet S is a sheet constituted by pasting together a thermal sensitive film and a porous supporter. Further, an upper side of the frame 6 can be opened from a closed state shown in FIG. 1 by a press plate frame 9 opening and closing via a support shaft 8.

In FIG. 1, between the master holder 7 and the printing drum 2B, there are respectively provided successively from the side of the master holder 7, a nip roller 10 and a tension roller 11, a platen roller 12 and a thermal head 13 and a cutter unit 14. Stencil sheet S is transferred via these rolls and thermally perforated by the thermal head 13.

As shown by FIG. 1, the nip roller 10 is rotatably supported via a shaft 15 supported by the side of the press plate frame 9. The press plate frame 9 is formed with a long hole (not illustrated) which is long in the vertical direction and the shaft 15 is supported via the long hole. Thereby, the nip roller 10 is movable in the up and down direction and is brought into contact with the tension roller 11 by its own weight.

The tension roller 11 is rotatably supported via a shaft 16 supported by the side of the frame 6 on the lower side of the nip roller 10. The peripheral face of the tension roller 11 is provided with a high friction material such as rubber or subjected to a surface treatment to produce a high friction state. Therefore, stencil sheet S transferred by being brought into contact with the tension roller 11 is restrained from slipping. Further, the shaft 16 of the tension roller 11 is provided with a torque limiter (not illustrated). Therefore, in transferring stencil sheet S, the tension roller 11 is not idly rotated and constant torque is generated.

Stencil sheet S drawn from stencil sheet S in a shape of a roll is transferred by being sandwiched between the nip roller 10 and the tension roller 11. The tension roller 11 prevents transferred stencil sheet S from slipping by the surface treatment. Further, since the torque limiter is provided at the shaft of the tension roller 11, the tension roller 11 is not idly rotated and constant torque is generated in transferring stencil sheet S. Thereby, stencil sheet S sandwiched by the tension roller 11 and the nip roller 10 is transferred to between the platen roller 12 and the thermal head 13 in a state of always being exerted with constant tension.

As shown by FIG. 1, the thermal head 13 is attached to the press plate frame 9. The thermal head 13 is formed substantially in a shape of a short strip which is long in the depth direction of FIG. 1. The thermal head 13 is installed orthogonally to a transfer direction of transferred stencil sheet S and is brought into contact with an upper face of the stencil sheet S. At a lower face of the thermal head 13, there is formed a processing face having a plurality of heat generating members aligned in parallel with the width direction of stencil sheet S for stencil making stencil sheet S by heat.

The thermal head 13 thermally perforates stencil sheet S by selectively driving the respective heat generating members by input of image information. The image information is outputted from reading means, not illustrated. As the reading means, there is used an optical type reading apparatus which is scanned relative to original or direct input from a personal computer by data transfer. When the optical type reading apparatus is adopted, the apparatus can be constituted as a portion of the constitution of the stencil printing machine.

Further, the thermal head 13 is made movable in a direction of approaching the platen roller 12 or regressing therefrom by driving means 17. In stencil making stencil sheet S, the processing face of the thermal head 13 is opposed to the platen roller 12. And the thermal head 13 is separated upwardly from the platen roller 12 after perforation.

The driving means 17 is provided on the side of the press plate frame 9 and is provided with a solenoid 18 and an arm 19. An operating rod 20 of the solenoid 18 is attached with one end of a tension coil spring 21. Other end of the tension coil spring 21 is attached to a portion of the arm 19. The arm 19 is provided pivotably relative to the press plate frame 9. Further, the arm 19 is attached with the thermal head 13. In a state in which the solenoid 18 is not operated and the operating rod 20 is drawn, the thermal head 13 approaches the platen roller 12 by being pushed down to the lower side via the arm 19 urged by spring force of the tension coil spring 21. Further, in a state in which the solenoid 18 is operated and the operating rod 20 is pushed out, the thermal head 13 is lifted upwardly via the tension coil 21 and the arm 19 to thereby separate from the platen roller 12.

The platen roller 12 is disposed to be opposed to the lower side of the thermal head 13, provided on the side of the frame 6. The platen roller 12 is driven to rotate in the counterclockwise direction of FIG. 1 by a drive mechanism, not illustrated, provided on the side of the frame 6.

Further, thermal head claws 22 are provided at both ends of the thermal head 13. The thermal head claws 22 are engaged with a shaft 23 of the platen roller 22 when the press plate frame 9 is closed. And the thermal head 13 and the platen roller 12 are positioned to be opposed to each other.

As described above, stencil sheet S which has passed through the tension roller 11 and the nip roller 10, is sandwiched between the platen roller 12 and the thermal head 13 which are brought into contact with each other. Stencil sheet S is perforated by thermal perforation by the thermal head 13 while being transferred by the rotating platen roller 12. Perforated stencil sheet S is transferred by driving to rotate the platen roller 12 and is transferred to the side of the cutter unit 14.

The cutter unit 14 is provided in the frame 6 and is constituted to pass stencil sheet S. At a portion thereof for passing stencil sheet S, there is provided a cutter movable in the depth direction of FIG. 1, that is, in the width direction of stencil sheet S. Further, stencil sheet S is cut in accordance with movement of the cutter.

In this way, the stencil making apparatus constitutes a stencil making unit with the frame 6 as a base portion thereof. Further, the frame 6 (stencil making unit) is made movable by a moving mechanism relative to the machine body 1 of the stencil printing machine.

An explanation will be given of the moving mechanism as follows. The frame 6 is supported on the side of the machine body 1 by a guide portion to be movable in the left direction from a position disposed in FIG. 1 to the respective printing drums 2A and 2B. With regard to the guide portion, although not particularly illustrated, for example, there is conceivable a constitution in which a guide rail is provided to the machine body 1 and the frame 6 is engaged with the guide roll to move along the guide rail. Further, the guide portion according to the embodiment is constituted to move the frame 6 in the horizontal direction since the respective printing drums 2A and 2B are arranged such that the axis lines of their own are horizontal thereby. In this way, the guide portion supports the frame 6 (stencil making unit) in a direction in correspondence with arrangement of the plurality of printing drums 2A and 2B.

The frame 6 movably supported by the guide portion is driven to move by a drive section. The drive section is arranged on the side of the machine body 1 and on the side of the frame 6. On the side of the machine body 1, there is provided a rack gear 25 along the direction of moving the frame 6. Further, the frame 6 is provided with a gear 26 always in mesh with the rack gear 25 in accordance with movement of its own. The gear 26 is fixed by a shaft 29 rotatably supported by the side of the frame 6. Further, the frame 6 is provided with a drive motor 27. A drive gear 28 is provided to an output shaft of the drive motor 27. The drive gear 28 is in mesh with a driven gear 30 fixed to the shaft 29 of the gear 26.

When the drive motor 27 is driven, rotation is transmitted to the shaft 29 via the drive gear 28 and the driven gear 30 and the gear 26 is rotated. The gear 26 is rolled by rotation of its own in a state of being brought in mesh with the rack gear 25. Thereby, the shaft 29 is moved along the rack gear 25 and the frame 6 is moved.

The position of the frame 6 moved by the drive section is detected by position detecting means. Position sensors 31 are provided on the side of the machine body 1. The position sensor 31 according to the embodiment is provided with a pair of light projecting and receiving portions. The position sensors 31 are arranged at a total of three locations of positions for detecting that the frame 6 is moved to positions for delivering an end portion of perforated stencil sheet S to the respective printing drums 2A and 2B and a position for detecting that the frame 6 is moved to substantially a middle portion of the respective printing drums 2A and 2B (that is, a position constituting substantially equal distance from the respective printing drums 2A and 2B). Further, on the side of the frame 6, there is provided a shield plate 32 for shielding the light projecting and receiving portions of the position sensors 31. The shield plate 32 shields the light projecting and receiving portions of the respective position sensors 31 in accordance with movement of the frame 6.

Here, an explanation will be given of a specific relationship between the position sensors 31 and the shield plate 32 in accordance with movement of the frame 6. As shown by FIG. 1, when the frame 6 (stencil making unit) is disposed at a position for delivering stencil sheet S to the printing drum 2B, the shield plate 32 shields only the position sensor 31*a* on the right side. In order to set the stencil making unit at the position, the frame 6 is moved in the right direction from the state in FIG. 1. And from a position at which all of the position sensors 31 are not shielded by the shield plate 32, the frame 6 is moved to return in the left direction and movement of the frame 6 is stopped at the position at which the position sensor 31*a* is shielded again by the shield plate 32.

Further, as shown by FIG. 2, when the frame 6 (stencil making unit) is disposed at the position for delivering stencil sheet S to the printing drum 2A, both of the position sensor 31*c* on the left side and the position sensor 31*b* at the center are shielded by the shield plate 32. In order to set the stencil making unit at the position, the frame 6 is moved in the left direction from a state in which only the position sensor 31*b* is shielded by the shield plate 32. And movement of the frame 6 is stopped at the position in which the position sensor 31*c* is shielded by the shield plate 32.

Further, as shown by FIG. 3, when the frame 6 (stencil making unit) is disposed at the middle position between the respective printing drums 2A and 2B, both of the position sensor 31*b* at the center and the position sensor 31*a* on the right side are shielded by the shield plate 32. In order to set the stencil making unit at the position, in the case of moving from the state of FIG. 1, the frame 6 is moved in the left direction from the state in which only the position sensor 31*a* is shielded by the shield plate 32. And movement of the frame 6 is stopped at the position at which the position sensor 31*b* is shielded by the shield plate 32. Further, in the case of moving from the state of FIG. 2, the frame 6 is moved in the right direction. And the movement in the right direction is continued even when the position sensor 31*c* is not shielded by the shield plate 32 and the position sensor 31*a* is shielded by the shield plate 32. Further, from the position at which the position sensor 31*b* is not shielded by the shield plate 32 (state in which only the position sensor 31*a* is shielded by the shield plate 32), the frame 6 is moved to return in the left direction. And the movement of the frame 6 is stopped at the position at which the position sensor 31*b* is shielded again by the shield plate 32.

Next, an explanation will be given of operation of the stencil making apparatus. In order to set stencil sheet S between the respective rollers, the press plate frame 9 is opened upwardly. At this occasion, the nip roller 10 and the thermal head 13 arranged on the side of the press plate frame 9 are lifted along with the press plate frame 9. The nip roller 10 is separated from the tension roller 11. And the thermal head 13 is separated from the platen roller 12. Under the state, stencil sheet S in the shape of the continuous strip is drawn from stencil sheet S in the shape of a roll contained in the master holder 7. The stencil sheet S is arranged to be brought into contact with peripheral faces of respective upper sides of the tension roller 11 and the platen roller 12. Further, the press plate frame 9 is closed and stencil sheet S is sandwiched between the nip roller 10 and the tension roller 11 and between the thermal head 13 and the platen roller 12.

In stencil making operation, image information is provided from reading means (not illustrated) to the thermal head 13. The thermal head 13 forms perforated image in correspondence with the image information on stencil sheet S sandwiched between the thermal head 13 and the platen roller 12. In the stencil making operation, stencil sheet S is transferred only by the drive force of the platen roller 12 while directing the front end to the printing drum 2A (2B) with which the frame 6 (stencil making unit) corresponds.

In the stencil making operation, stencil sheet S which is transferred by being drawn from stencil sheet S in the shape of a roll, is sandwiched between the tension roller 11 having the torque limiter and the nip roller 10 and therefore, stencil sheet S is transferred to the side of the thermal head 13 in a state of being always exerted with constant tension. Therefore, slack is not produced in transferred stencil sheet S and wrinkle is difficult to produce in stencil sheet S after perforation.

Further, the stencil making apparatus transfers and sets stencil sheet S perforated as described above to the printing drum 2A (2B). In the stencil making operation, the front end of perforated stencil sheet S is transferred to the clamp plate 4 of the printing drum 2A (2B) by rotation of the platen roller 12. The front end of stencil sheet S is fixed to the printing drum 2A (2B) by the clamp plate 4. Further, there is carried out setting operation for rotating the printing drum 2A (2B) and winding stencil sheet S on the peripheral face of the printing drum 2A (2B). Further, in setting stencil sheet S to the printing drum 2A (2B), at a time point at which perforation of one block has been finished, the processing face 13*a* of the thermal head 13 is separated from the platen roller 12 by the driving means 17 to thereby release sandwiching of stencil sheet S and stencil sheet S is cut by the cutter unit 14.

Further, the stencil making apparatus concerns a series of operation of stencil making and setting as mentioned above and carries out stencil making and setting to the respective printing drums 2A and 2B by moving the frame 6 (stencil making unit).

As shown by FIG. 1, after carrying out stencil making and setting operation at the printing drum 2B (right side), stencil making and setting at the printing drum 2A (left side) are carried out. With regard to movement of the frame 6, the movement is carried out by the above-described moving mechanism. Further, with regard to the moving position of the frame 6, the moving position is detected by the above-described position detecting means. That is, by driving the drive motor 27 of the moving mechanism, the frame 6 is moved to the printing drum 2A. Further, movement of the frame 6 is stopped when the position sensor 31*c* of the position detecting means detects that the frame 6 is disposed at the position in correspondence with the printing drum 2A as shown by FIG. 2. Further, after moving the frame 6, the above-described stencil making and setting operation are carried out. Thereby, setting perforated stencil sheet S to the respective printing drums 2A and 2B is finished.

Further, the stencil making apparatus can be moved to the middle position of the respective printing drums 2A and 2B other than moving to the positions in correspondence with the printing drums 2A and 2B. With regard to movement of the frame 6 (stencil making unit) to the middle position, the movement is carried out by the above-described moving mechanism. Further, with regard to the movement position of the frame 6, the movement position is detected by the above-described position detecting means. That is, by driving the drive motor 27 of the moving mechanism, the frame 6 is moved to the middle position substantially at equal distance from the respective printing drums 2A and 2B. Further, movement of the frame 6 is stopped when the position sensors 31 of the position detecting means detect that the frame 6 is disposed at the position in correspondence with the middle position of the respective printing drums 2A and 2B as shown by FIG. 3. Further, after setting operation of stencil sheet S to the respective printing drums 2A and 2B has been finished, when the frame 6 (stencil making unit) is stopped at the middle position at substantially equal distance from the respective printing drums 2A and 2B as an initial position, the movement distance of the frame 6 (stencil making unit) to either of the printing drums 2A and 2B can be made uniform. And in selecting the respective printing drums 2A and 2B, movement of the stencil making unit can be carried out swiftly.

Printing is carried out after setting stencil sheet S perforated by the stencil making apparatus to the respective printing drums 2A and 2B. In printing operation, the respective drums 2A and 2B are rotated and as shown by an arrow mark A of FIG. 1, print sheet is transferred between the printing drum 2A and the corresponding pressing means 5 at a predetermined timing. The pressing means 5 presses print sheet to the image portion of stencil sheet S mounted to the printed drum 2A. Print ink supplied from the inner peripheral wall of the printing drum 2A permeates the peripheral wall 3 and is transcribed onto print sheet from the perforated portion of the stencil sheet S. Print sheet is formed with perforated image at the printing drum 2A.

Print sheet formed with the perforated image at the printing drum 2A is transferred to between the printing drum 2B and the corresponding pressing means 5 via the transfer means 40. The pressing means 5 presses print sheet to the image portion of the stencil sheet S mounted to the printing drum 2B. Print ink supplied from the inner peripheral wall of the printing drum 2B permeates the peripheral wall 3 and is transcribed onto print sheet from the perforated portion of stencil sheet S. Print sheet is formed with perforated image at the printing drum 2B. Further, as shown by an arrow mark B of FIG. 1, print sheet is discharged.

In this way, according to the stencil printing machine having the plurality of printing drums 2A and 2B, there can be carried out multiple printing or multiple color printing for carrying out printing operation at the printing drum 2A and thereafter, successively, carrying out printing operation at the printing drum 2B.

Meanwhile, according to the stencil printing machine for carrying out stencil making and setting operation with respect to the plurality of printing drums 2A and 2B by the single stencil making apparatus, it is necessary to carry out stencil making operation in correspondence with the respective printing drums 2A and 2B on the side of the stencil making apparatus and to set (transfer) perforated stencil sheet S in correspondence with the respective printing drums 2A and 2B. According to the stencil printing machine of the invention, there is provided printing drum information detecting means for detecting printing drum information of in which ink colors the respective printing drums 2A and 2B are set when the printing drums 2A and 2B are set to different ink colors and printing of different colors are carried out on print sheet.

The printing drum information detecting means for detecting the printing drum information are as shown below in correspondence with constitution of the printing drums 2A and 2B. First, when the printing drums 2A and 2B are constituted to be attachable to and detachable from the stencil printing machine, the respective printing drums 2A and 2B are made exclusive such as black color use, blue color use or red color use for respective ink colors used.

Figure 4:
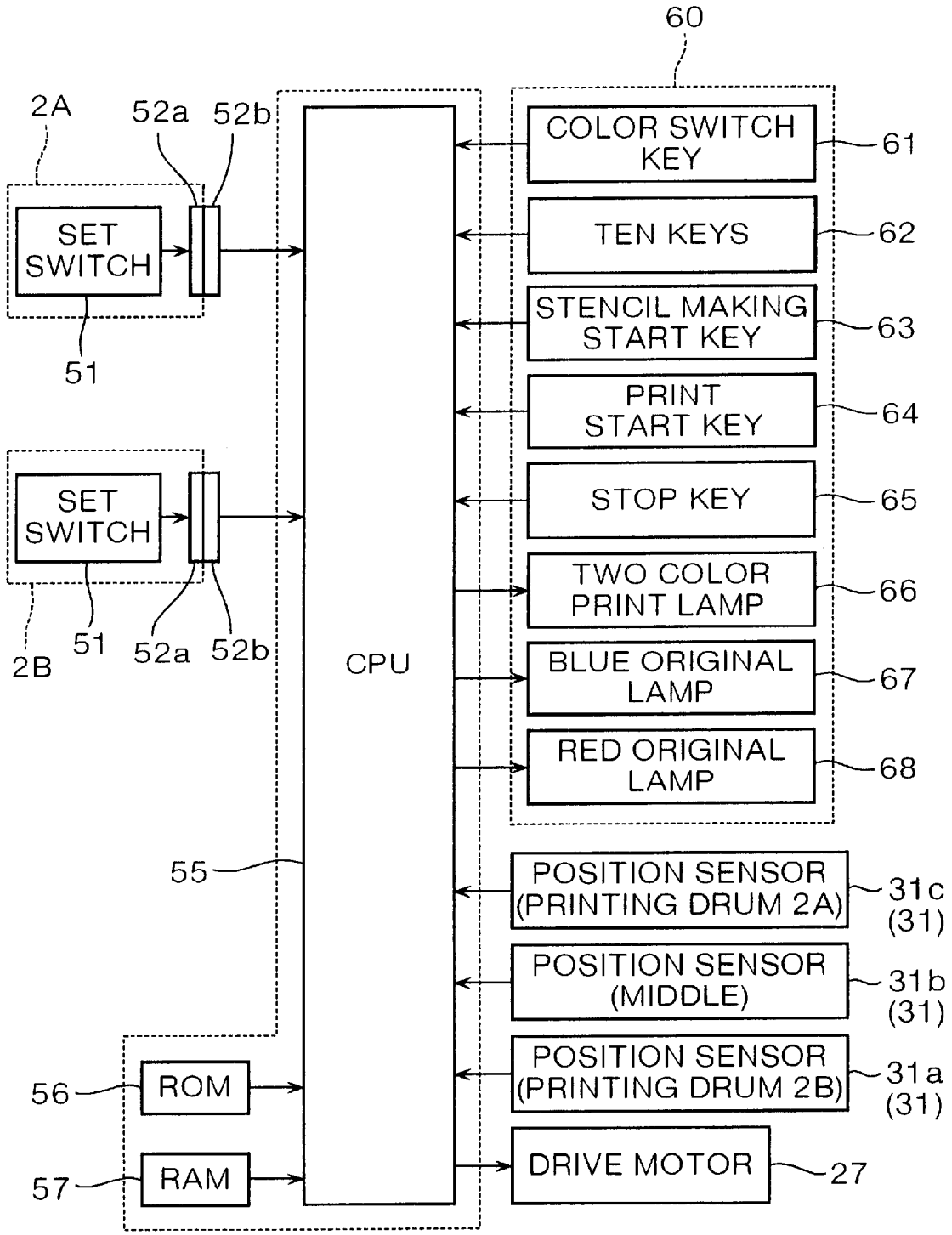
FIG. 4 is a block diagram showing control means of the stencil printing machine.

In this case, as shown by a block diagram of control means of FIG. 4, there are provided set switches 51 operated to switch in accordance with kind of ink color respectively set to the printing drums 2A and 2B. As the set switches 51, there are a plurality of dipswitches or rotary switches in correspondence with kinds of respective ink colors. Further, on the side of the printing drums 2A and 2B and on the side of the stencil printing machine, there are provided electric connectors 52*a* and 52*b* which are automatically connected when the printing drums 2A and 2B are set to the stencil printing machine. Printing drum information set by the set switches 51 is transferred to control means in the stencil printing machine, mentioned later, by connecting the electric connectors 52*a* and 52*b*. In this way, the set switches 51 constitutes printing drum information detecting means for providing printing drum information of ink colors of the printing drums 2A and 2B.

Figure 5:
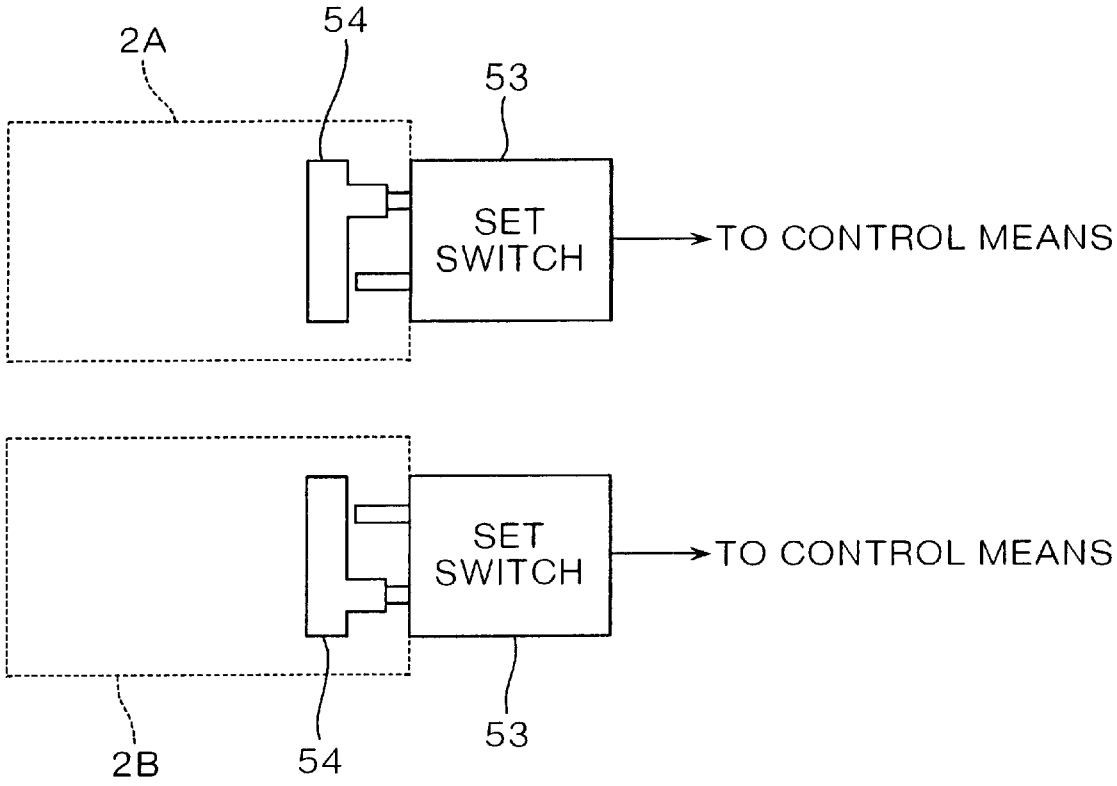
FIG. 5 is a block diagram showing other constitution of printing drum information detecting means.

Further, when the printing drums 2A and 2B are constituted to be attachable to and detachable from the stencil printing machine, as shown by FIG. 5, set switches 53 may be provided to the side of the stencil printing machine and set members 54 for operating the set switches 53 may be provided on the side of the printing drums 2A and 2B. The set switches 53 comprise pluralities of dipswitches in correspondence with kinds of respective ink colors. The set plates 54 comprise projected pieces for depressing any one of the respective dipswitches. Further, the set plates 54 are constituted by projecting portions thereof in correspondence with ink colors set to the printing drums 2A and 2B. When the printing drums 2A and 2B are set to the stencil printing machine, dipswitches in correspondence with set ink colors are depressed. Further, printing drum information set by the set switches 53 is transferred to the control means in the stencil printing machine, mentioned later. In this way, the set switches 53 and the set plates 54 constitute printing drum information detecting means for providing printing drum information such as ink colors of the printing drums 2A and 2B.

Further, there also is a constitution in which the printing drums 2A and 2B are fixed to the stencil printing machine. In this case, ink supplying means in the printing drums 2A and 2B are cleaned and changed to other ink colors. When the printing drums 2A and 2B are fixed to the stencil printing machine in this way, although not illustrated, the above-described set switches 51 are provided on the side of the stencil printing machine. Further, after changing the ink colors, printing drum information set by the set switches 51 is transmitted to control means in the stencil printing machine, mentioned later. In this way, the set switches 51 constitute printing drum information detecting means for providing printing drum information of ink colors of printing drums 2A and 2B.

An explanation will be given of control means for transmitting printing drum information from the printing drum information detecting means. The control means generally controls all of operation of the stencil printing machine including movement of the stencil making unit (frame 6).

As shown by the block diagram of FIG. 4, the control means is constituted as a one chip microcomputer including CPU 55 constituted by a microprocessor, ROM 56 stored with programs for controlling respective mechanisms in the stencil printing machine and RAM 57 for storing operation results of the microprocessor and various input information as necessary.

The control means inputs printing drum information by various key information from an operation panel 60 arranged at an upper face of the cabinet of the stencil printing machine, ON/OFF information of the respective position sensors 31 and printing drum information by the set switches 51 and 53. The control means holds the printing drum information respectively in RAM 57.

CPU 55 determines an efficient order of stencil making and setting operation. CPU 55 displays instruction to the operator at the operation panel 60.

Figure 6:
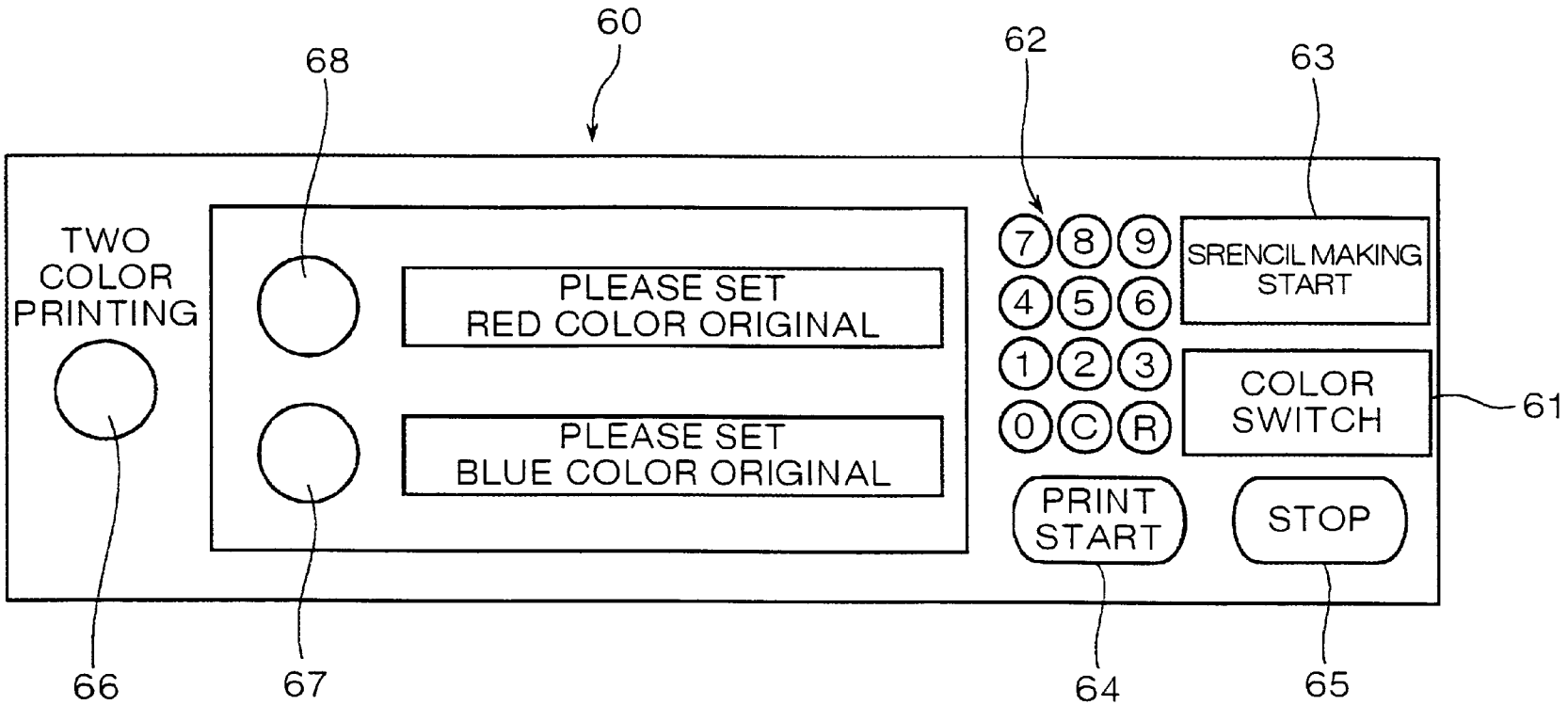
FIG. 6 is a front view showing an operation panel.

As shown by FIG. 6, the operation panel 60 is provided with various keys of a color switch key 61, ten keys 62, a stencil making start key 63, a print start key 64 and a start key 65.

The color switch key 61 is a key for selectively switching whether two color printing is carried out or single color printing is carried out and selectively switching color perforated in the case of single color printing, that is, at which of the printing drums 2A and 2B stencil sheet sets thereto is perforated. The color switch key 61 is switched in the order of two color printing→single blue color printing→single red color printing→two color printing . . . at every time of depressing thereof (when the printing drums 2A and 2B are respectively set to blue color ink and red color ink).

The ten keys 62 are constituted by numeral keys of 0 through 9 for setting a number of print sheets.

The stencil making start key 63 is operated to depress when stencil making and setting operation is carried out after setting the color switch key 61 and the ten keys 62.

The print start key 64 is operated to depress when printing operation is carried out after stencil making operation. Further, the stop key 65 is operated to depress when the operation is stopped in printing operation.

The operation panel 60 is arranged with displaying means. In the displaying means, various information of the stencil printing machine is displayed. As shown by FIG. 6, there are two color print lamp 66, original lamps 67 and 68 in the displaying means according to the embodiment.

The two color print lamp 66 is switched on or off by switching the color switch key 61. The two color print lamp 66 according to the embodiment is switched on in switching to two color print mode and is switched off in switching to single color (blue color, red color) print mode.

The original lamps 67 and 68 are switched on or switched off in correspondence with a display for expediting the operator concerning in which color original printed thereby is set to reading means in correspondence with the printing drum information. Specifically, in the case of the single color print mode, one in correspondence with switched color is switched off. Further, in the case of the two color print mode, the operator is expedited with respect to by which color stencil making is carried out. For setting original of the color to reading means, one in correspondence with the color is switched on. According to the embodiment, the printing drums 2A and 2B are supplied with ink of blue color and red color and are set such that printing is carried out by ink colors of blue color and red color. The original lamp 67 is constituted by blue original lamp and the original lamp 68 is constituted by red original lamp.

In this way, in correspondence with printing drum information of the respective printing drums 2A and 2B detected by the printing drum information detecting means, the displaying means is displayed with perforation instructing information expediting the operator with respect to which original is set to reading means.

An explanation will be given of control with regard to printing mode switching operation by the above-described control means in reference to a control flow of FIG. 7. In the control flow, in starting operation, a single blue color print mode is constituted and only the blue original lamp 67 is brought into a switched on state and the red original lamp 68 and two color print lamp 66 are brought into a switched off state (ST1).

At this occasion, when single blue color printing is carried out, in accordance with instruction of the blue original lamp 67, the operator sets blue original used in stencil making to reading means.

Next, it is confirmed whether the stencil making start key 63 is depressed and when the stencil making start key 63 is depressed (ST2-Yes), the operation proceed to blue color stencil making operation (ST3).

Figure 8:
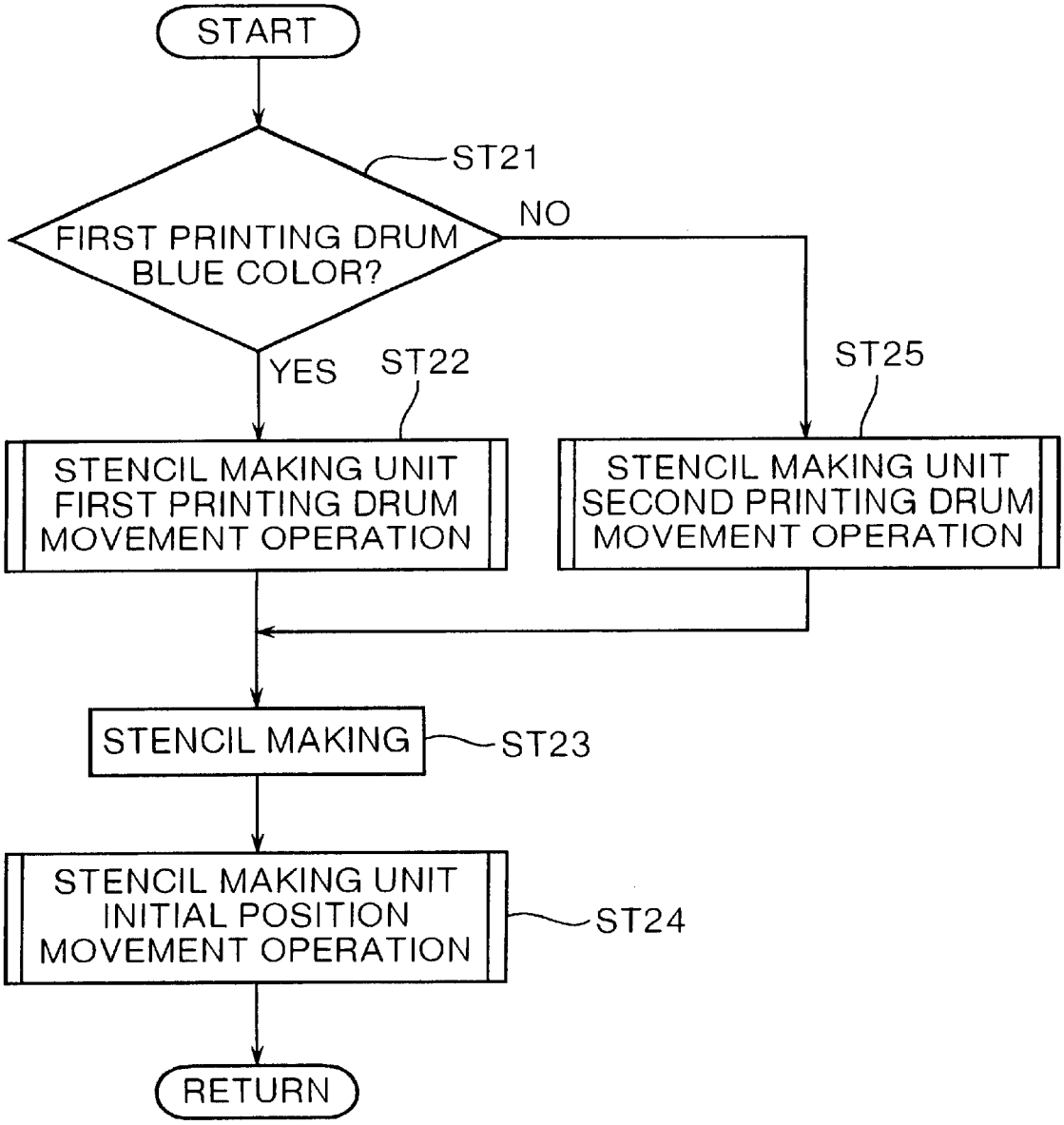
FIG. 8 shows a control flow indicating blue color stencil making operation.

FIG. 8 shows a control flow of the blue color stencil making operation. First, it is determined whether ink supplied to the printing drum 2A (first printing drum) is blue color by information transmitted from the printing drum information detecting means. When ink supplied to the printing drum 2A (first printing drum) is blue color (ST21-Yes), the frame 6 constituting the stencil making unit is moved to the side of the printing drum 2A (first printing drum) (ST22).

Figure 9:
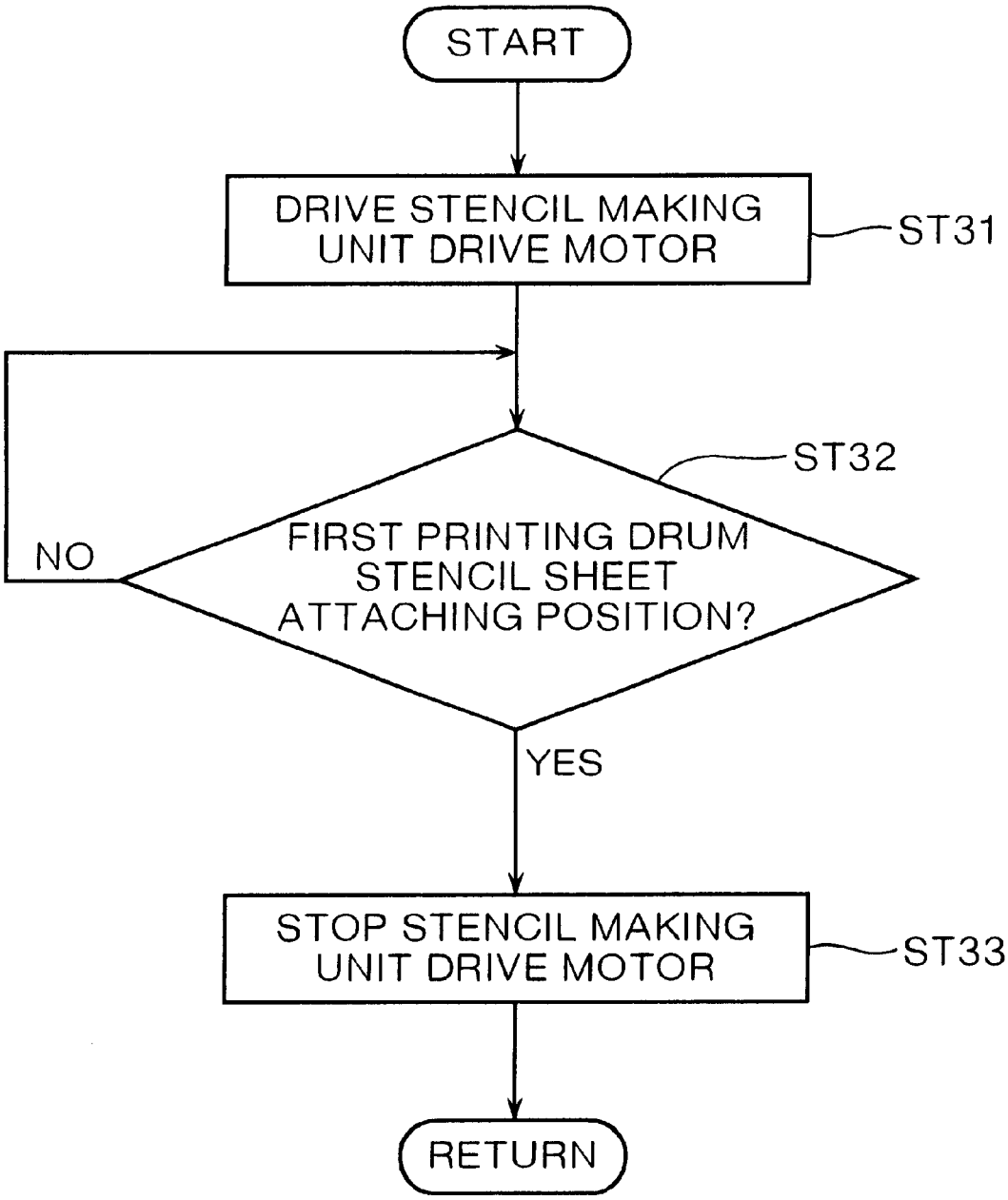
FIG. 9 shows a control flow indicating operation of moving a stencil making unit to a first printing drum side.

FIG. 9 shows a control flow of movement operation of the stencil making unit to the side of the printing drum 2A (first printing drum). First, the drive motor 27 provided at the frame 6 constituting the stencil making unit is driven. The frame 6 is moved from the middle portion of the printing drum 2A (first printing drum) and the printing drum 2B (second printing drum) constituting the initial position in the direction of the printing drum 2A (first printing drum) direction (ST31). During a time period in which the frame 6 (stencil making unit) is not disposed at a first printing drum stencil sheet attaching position for attaching stencil sheet S to the printing drum 2A (first printing drum), that is, during a time period until detection by the position sensor 31*c* is established, the frame 6 continues moving by the drive motor 27 (ST32-No). Further, when the frame 6 is disposed at the first printing drum stencil sheet attaching position (ST32-Yes), the drive motor 27 is stopped and the movement of the frame 6 is stopped (ST33).

Thereafter, as shown by FIG. 8, there is carried out stencil making and setting processing with regard to blue original at the printing drum 2A (first printing drum) by the stencil making apparatus (ST23). When the stencil making and setting operation is finished, the stencil making unit is moved to the initial position and is on standby (ST24).

Figure 10:
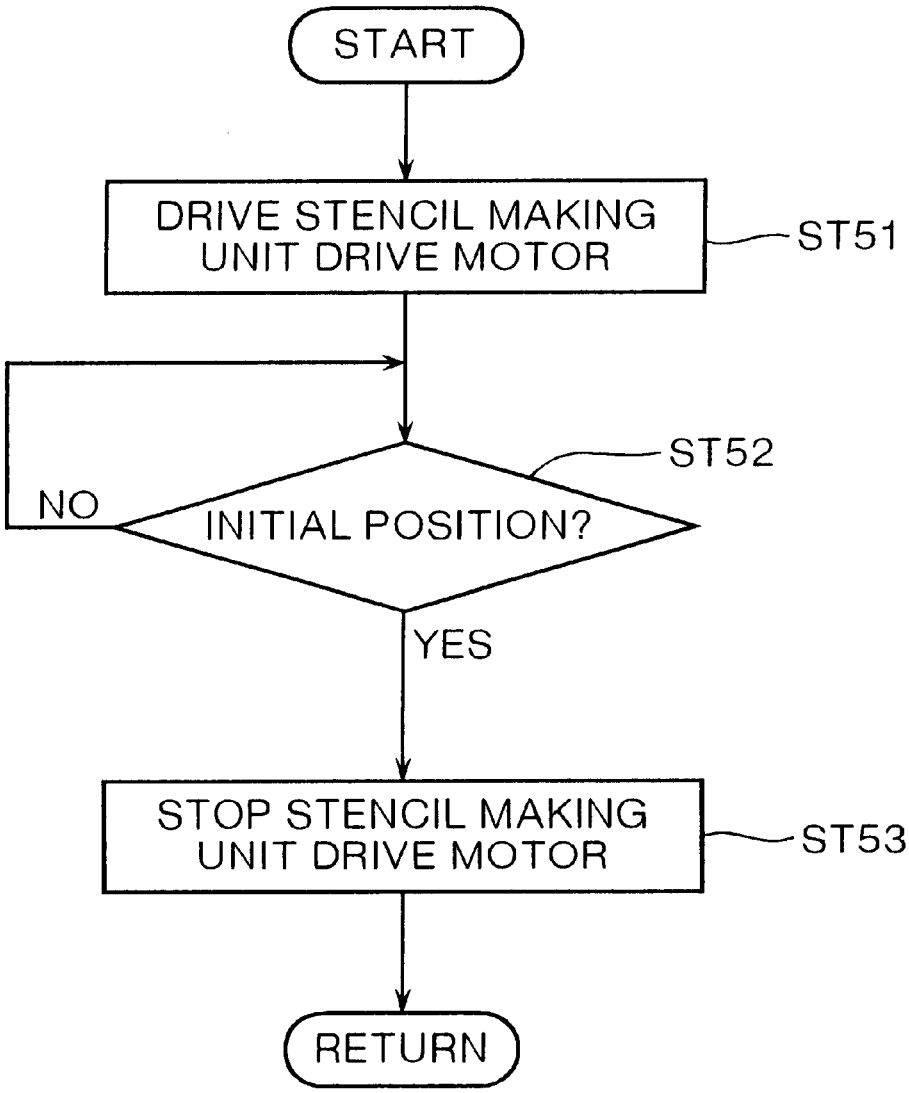
FIG. 10 shows a control flow indicating operation of moving the stencil making unit to an initial position.

FIG. 10 shows a control flow of movement operation of the stencil making unit to the initial position. First, by driving the drive motor 27, the frame 6 is moved from the first printing drum stencil sheet attaching position in the direction of the printing drum 2B (second printing drum) (ST51). During a time period in which the frame 6 is not disposed at the initial position, the frame 6 continues moving by the drive motor 27 (ST52-No). Further, when the frame 6 is disposed at the initial position (ST52-Yes), the drive motor 27 is stopped and movement of the frame 6 is stopped (ST53).

Further, by depressing the print start key 64, print sheet is transferred to the printing drum 2A (first printing drum) and printing operation by blue color ink supplied to the printing drum 2A is carried out with respect to the print sheet.

Further, as shown by FIG. 8, when ink supplied to the printing drum 2A (first printing drum) is not blue color at ST21 (ST21-No), the frame 6 constituting the stencil making unit is moved to the side of the printing drum 2B (second printing drum) (ST25).

Figure 11:
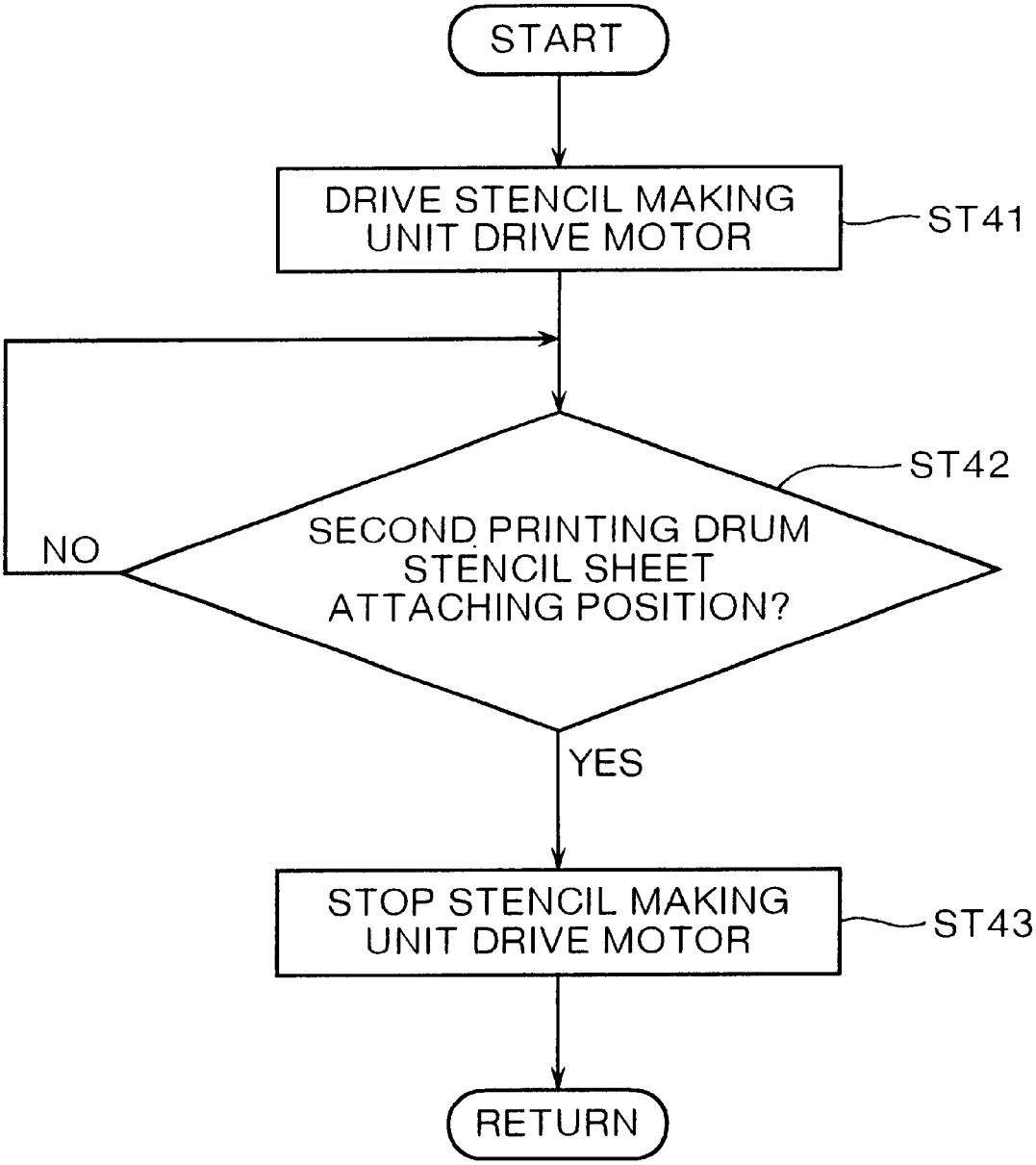
FIG. 11 shows a control flow indicating operation of moving the stencil making unit to a second printing drum side.

FIG. 11 shows a control flow of movement operation of the stencil making unit to the side of the printing drum 2B (the second printing drum). First, the drive motor 27 provided at the frame 6 constituting the stencil making unit is driven. And the frame 6 is moved from the middle portion of the printing drum 2A (first printing drum) and the printing drum 2B (second printing drum) constituting the initial position in the direction of the printing drum 2B (second printing drum) (ST41). During a time period in which the frame 6 (stencil making unit) is not disposed at the second printing drum stencil sheet for attaching position attaching stencil sheet to the printing drum 2B (second printing drum), that is, during a time period until detection by the position sensor 31*a* is established, the frame 6 continues moving by the drive motor 27 (ST42-No). Further, when the frame 6 is disposed at the second printing drum stencil sheet attaching position (ST42-Yes), the drive motor 27 is stopped and the movement of the frame 6 is stopped (ST43).

Thereafter, as shown by FIG. 8, stencil making and setting operation with respect to blue original is carried out at the printing drum 2B (second printing drum) by the stencil making apparatus (ST23). When the stencil making and setting operation is finished, the stencil making unit is moved to the initial position (ST24).

That is, as shown by FIG. 10, by driving the drive motor 27, the frame 6 is moved from the second printing drum stencil sheet attaching position in the direction of the printing drum 2A (first printing drum) (ST51). During a time period in which the frame 6 is not disposed at the initial position, the frame 6 continues moving by the drive motor 27 (ST52-No). Further, when the frame 6 is disposed at the initial position (ST52-Yes), the drive motor 27 is stopped and movement of the frame 6 is stopped (ST53).

Further, by depressing the print start key 64, print sheet is transferred to the printing drum 2B (second printing drum) and printing operation by blue color supplied to the printing drum 2B is carried out with respect to the print sheet.

Figure 7:
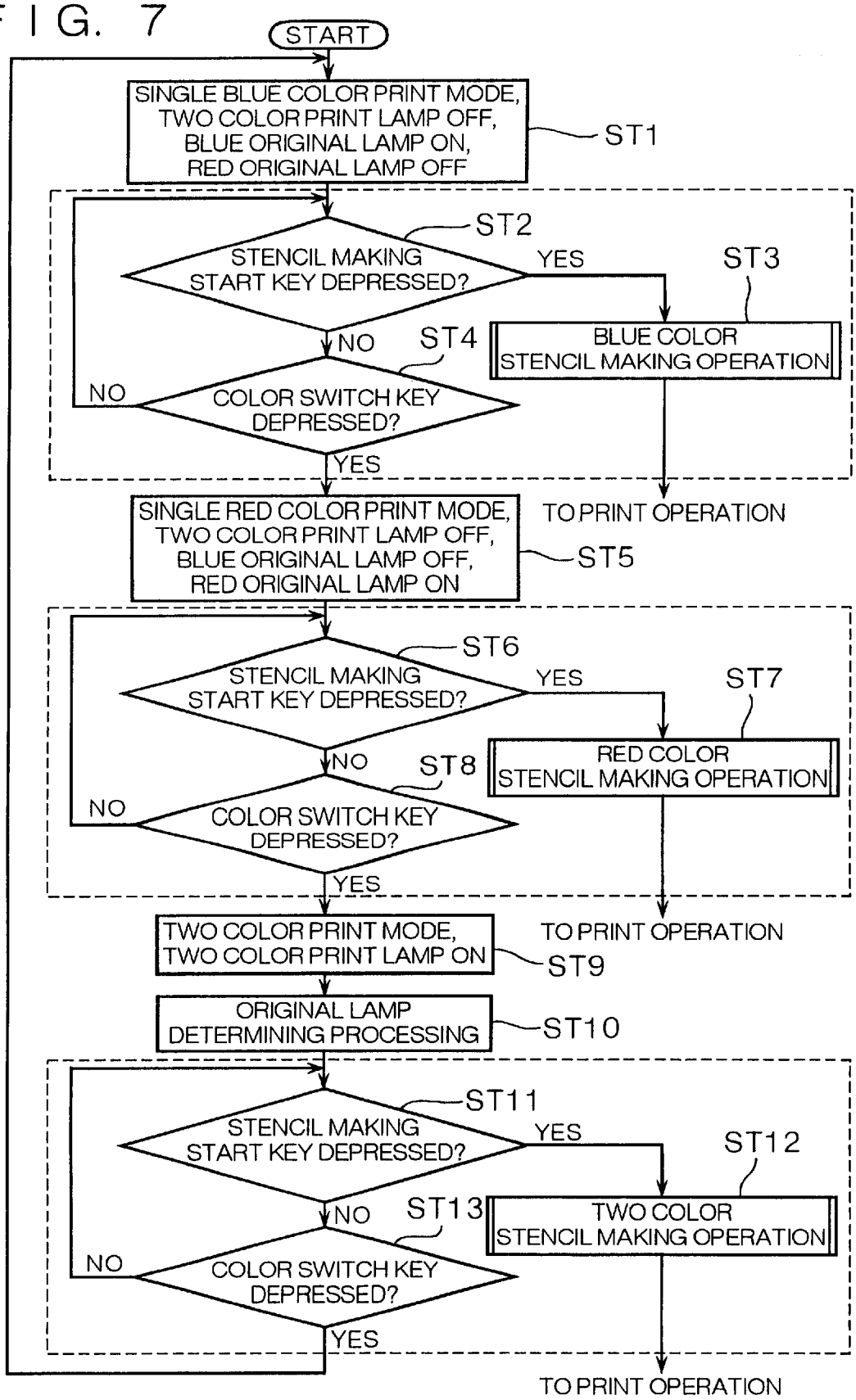
FIG. 7 shows a control flow indicating print mode switching operation.

Further, as shown by FIG. 7, when depression of the stencil making start key 63 is not confirmed at step ST2 (ST2-No), it is confirmed whether the color switch key 61 is depressed. And when the depression is not confirmed (ST4-No), the operation proceeds to a state of confirming the depression of the stencil making start key 63 again (return to the ST2). In contrast thereto, when depression of the color switch key 61 is confirmed (ST4-Yes), the operation proceeds to single red color print mode (ST5). At this occasion, when the red original lamp 68 is switched on, the blue original lamp 67 is switched off and the two color print lamp 66 is brought into the switched off state continuously.

Successively, as shown by FIG. 7, in the single red color print mode, depression of the stencil making start key 63 is confirmed (ST6). The operator sets red original used in stencil making to reading means in accordance with instruction of the red original lamp 68 when single red color printing is carried out. Further, when the stencil making start key 63 is depressed (ST6-Yes), the operation proceeds to red color stencil making operation (ST7).

Figure 12:
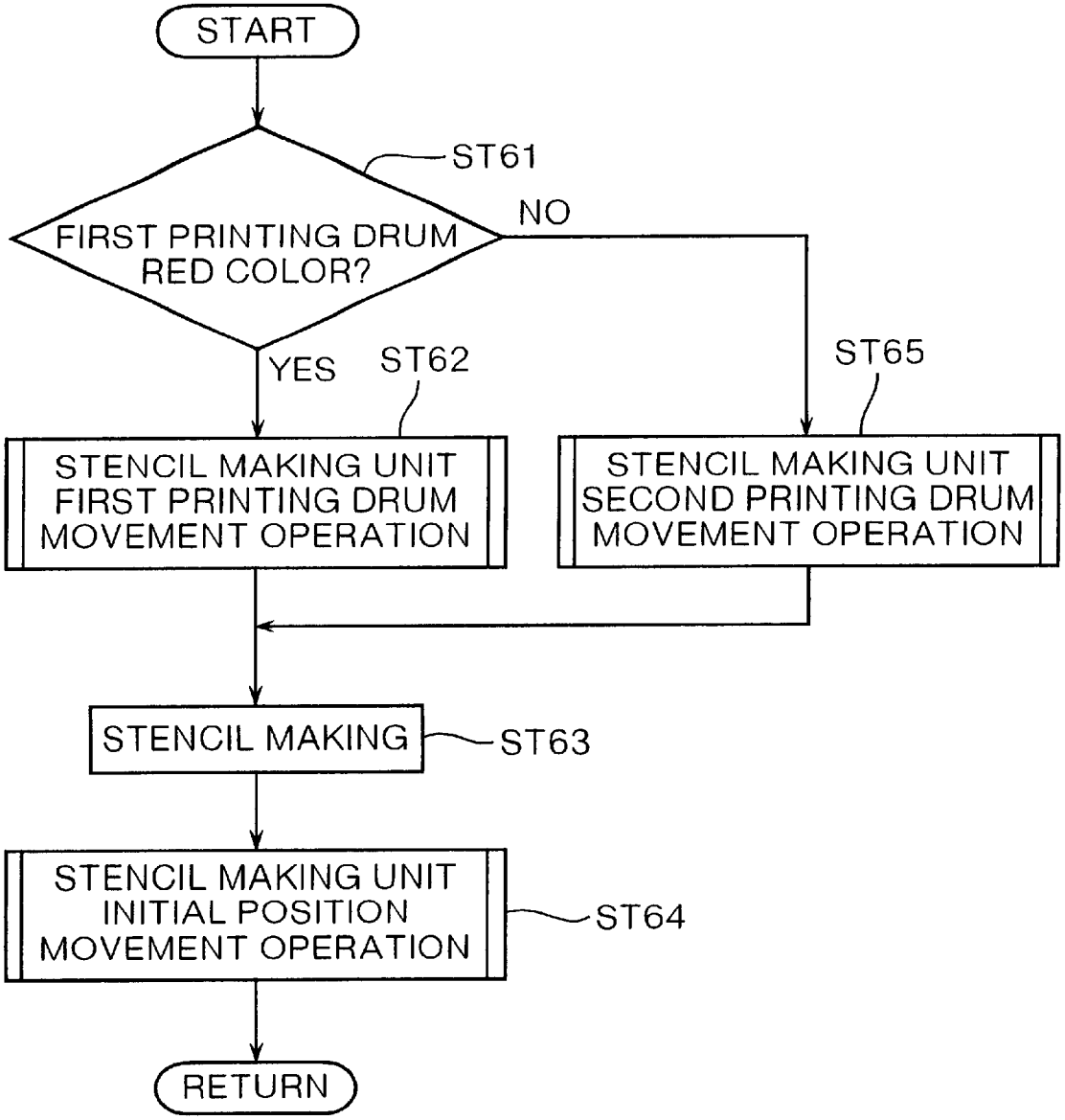
FIG. 12 shows a control flow indicating red color stencil making operation.

FIG. 12 shows a control flow of red color stencil making operation. First, it is determined whether ink supplied to the printing drum 2A (first printing drum) is red color by information transmitted from the printing drum information detecting means. When ink supplied to the printing drum 2A (first printing drum) is red color (ST61-Yes), the frame 6 constituting the stencil making unit is moved to the side of the printing drum 2A (ST62).

Thereafter, similar to the above-described blue color stencil making operation, as shown by FIG. 9, the frame 6 constituting the stencil making unit is moved to the side of the printing drum 2A (first printing drum) from the initial position (middle position) to the first printing drum stencil sheet attaching position. Thereby, stencil making and setting processing with respect to red original is carried out at the printing drum 2A (first printing drum). After finishing the stencil making and setting operation, as shown by FIG. 10, the stencil making unit is moved to the initial position and is on standby.

Further, by depressing the print start key 64, print sheet is transferred to the printing drum 2A (first printing drum). And the printing operation by red color ink supplied to the printing drum 2A is carried out with respect to the print sheet.

Further, as shown by FIG. 12, when ink supplied to the printing drum 2A (first printing drum) is not red color at io ST61 (ST61-No), the frame 6 constituting the stencil making unit is moved to the side of the printing drum 2B (second printing drum) (ST65).

Thereafter, similar to the above-described blue color stencil making operation, as shown by FIG. 11, the frame 6 constituting the stencil making unit is moved to the side of the printing drum 2B (second printing drum) from the initial position (middle position) to the second printing drum stencil sheet attaching position. Thereby, stencil making and setting operation is carried out with respect to the printing drum 2B (second printing drum). After finishing the stencil making and setting operation, as shown by FIG. 10, the stencil making unit is moved to the initial position and is on standby.

Further, by depressing the print start key 64, print sheet is transferred to the printing drum 2B (second printing drum). And printing operation by red color ink supplied to the printing drum 2B is carried out with respect to the print sheet.

Further, as shown by FIG. 7, when depression of the stencil making start key 63 is not confirmed at step ST6 (ST6-No), depression of the color switch key 61 is confirmed (ST8). When depression of the color switch key 61 is not confirmed (ST8-No), the operation proceeds to the state of confirming depression of the stencil making start key 63 again (return to ST6). In contrast thereto, when depression of the color switch key 61 is confirmed (ST8-Yes), there is brought about two color print mode and the two color print lamp 66 is switched on (ST9).

Here, in carrying out two color printing, in order to determine ink colors supplied to the printing drum 2A (first printing drum) and the printing drum 2B (second printing drum), there is carried out a processing of determining original lamp (ST10).

Figure 13:
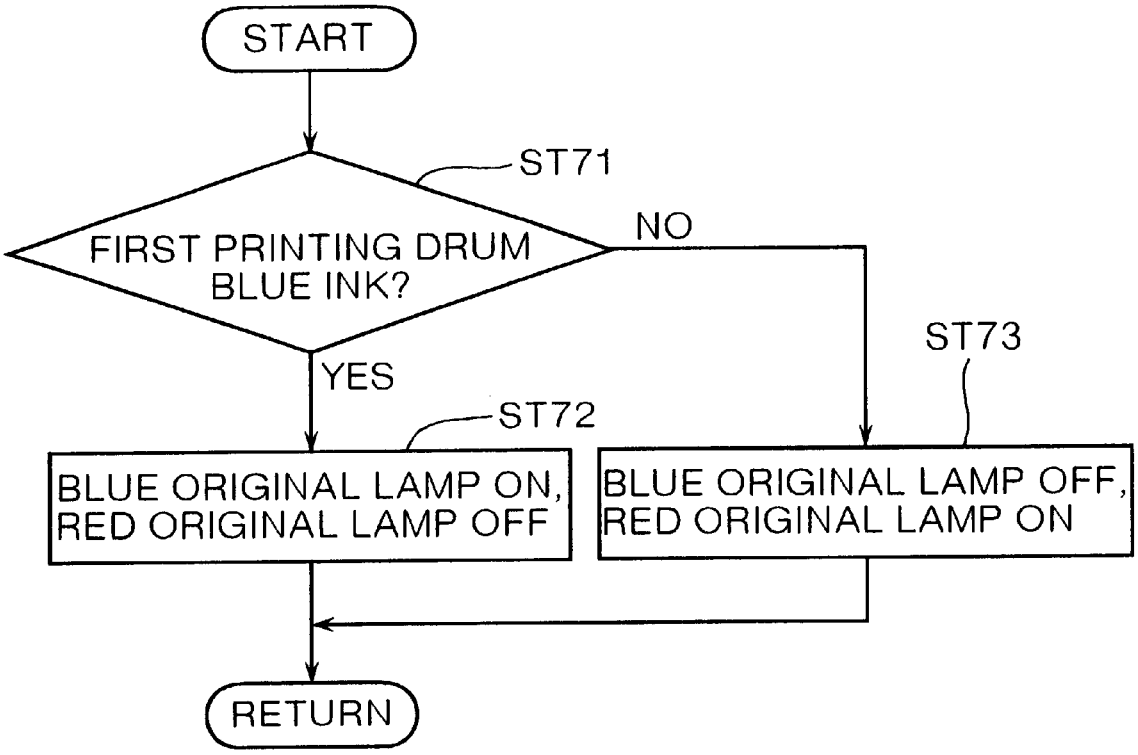
FIG. 13 shows a control flow indicating an original lamp determining processing.

FIG. 13 shows a control flow indicating a original lamp determining processing. First, it is determined whether ink supplied to the printing drum 2A (first printing drum) is blue color by information transmitted from the printing drum information detecting means. When ink supplied to the printing drum 2A (first printing drum) is blue color (ST71-Yes), the blue original lamp 67 is switched on and the red original lamp 68 is switched off (ST72).

Successively, as shown by FIG. 7, in the two color print mode, depression of the stencil making start key 63 is confirmed (ST11). The operator sets blue original used in the initial stencil making to reading means in accordance with instruction of the blue original lamp 67 when two color printing is carried out. Further, when the stencil making start key 63 is depressed (ST11-Yes), the operation proceeds to two color stencil making operation (ST12).

Figure 14:
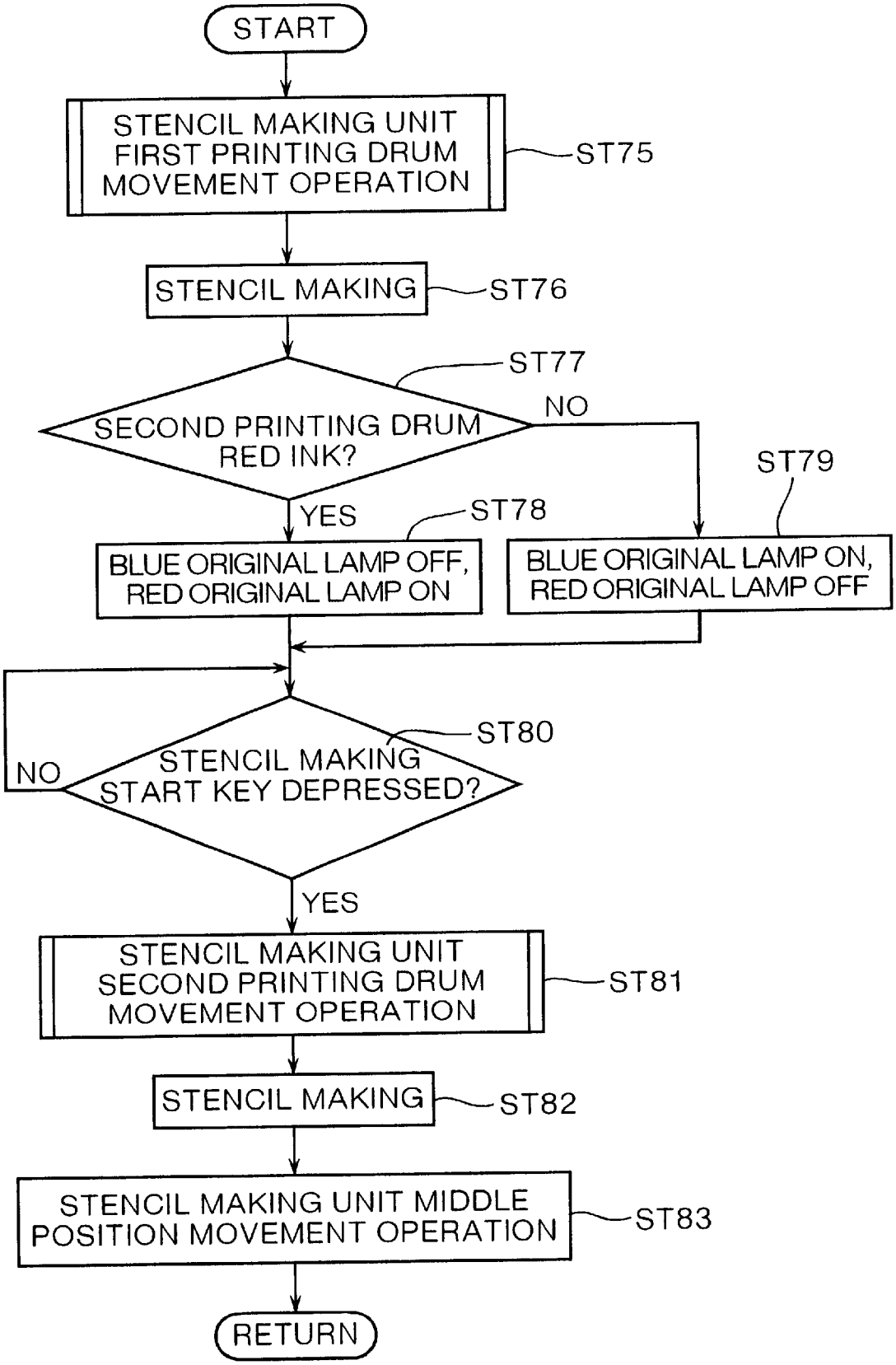
FIG. 14 shows a control flow indicating two color stencil making operation.

FIG. 14 shows a control flow of two color stencil making operation. When the operation proceeds to two color stencil making operation, the frame 6 constituting the stencil making unit is moved to the side of the printing drum 2A (first printing drum) (ST75).

That is, as shown by FIG. 9, the drive motor 27 provided at the frame 6 constituting the stencil making unit is driven. And the frame 6 is moved from the middle portion of the printing drum 2A (first printing drum) and the printing drum 2B (second printing drum) constituting the initial position in the direction of the printing drum 2A (first printing drum) (ST31). During a time period in which the frame 6 is not disposed at the first printing drum stencil sheet attaching position, the frame 6 continues moving by the drive motor 27 (ST32-No). Further, when the frame 6 is disposed at the first printing drum stencil sheet attaching position (ST32-Yes), the drive motor 27 is stopped and movement of the frame 6 is stopped (ST33). Further, there is carried out stencil making and setting processing with respect to blue original at the printing drum 2A (first printing drum) by the stencil making apparatus (ST76).

Next, ink color supplied to the printing drum 2B (second printing drum) is determined by information transmitted from the printing drum information detecting means. When ink supplied to the printing drum 2B (second printing drum) is red color (ST77-Yes), the red original lamp 68 is switched on and the blue original lamp 67 is switched off (ST78).

Thereafter, as shown by FIG. 14, the operator sets red original used in perforation of second color to reading means in accordance with instruction of the red original lamp 68. Further, when the stencil making start key 63 is depressed (ST80-Yes), the frame 6 constituting the stencil making unit is moved to the side of the printing drum 2B (second printing drum) (ST81).

That is, as shown by FIG. 11, the drive motor 27 provided at the frame 6 constituting the stencil making unit is driven. And the frame 6 is moved from the first printing drum stencil sheet attaching position in the direction of the printing drum 2B (second printing drum) (ST41). During a time period in which the frame 6 is not disposed at the second printing drum stencil sheet attaching position, the frame 6 continues moving by the drive motor 27 (ST42-No). Further, when the frame 6 is disposed at the second printing drum stencil sheet attaching position (ST42-Yes), the drive motor 27 is stopped and movement of the frame 6 is stopped (ST43). Further, stencil making and setting processing with respect to red original is carried out at the printing drum 2B (second printing drum) by the stencil making apparatus (ST82).

When the stencil making and setting operation is finished, the stencil making unit is moved to the initial position (ST83). That is, as show by FIG. 10, by driving the drive motor 27, the frame 6 is moved from the second printing drum stencil sheet attaching position in the direction of the printing drum 2A (first printing drum) (ST51). During a time period in which the frame 6 is not disposed at the initial position, the frame 6 continues moving by the drive motor 27 (ST52-No). Further, when the frame 6 is disposed at the initial position (ST52-Yes), the drive motor 27 is stopped and the movement of the frame 6 is stopped (ST53).

Further, by depressing the print start key 64, print sheet is transferred to the printing drum 2A (first printing drum). And printing operation by blue color ink supplied to the printing drum 2A is carried out with respect to the print sheet. Successively, the print sheet is transferred to the printing drum 213 (second printing drum) via the transfer means 40. And printing operation by red color supplied to the printing drum 2B is carried out with respect to the print sheet.

Further, as shown by FIG. 7, when depression of the stencil making start key 63 is not confirmed at ST11 (ST11-No), depression of the color switch key 61 is confirmed (ST13). When depression of the color switch key 61 is not confirmed (ST13-No), the operation proceeds to a state of confirming depression of the stencil making start key 63 again (return to ST11). In contrast thereto, when depression of the color switch key 61 is confirmed (ST13-Yes), the print mode becomes the single blue color print mode again, the two color print lamp 66 is switched off, the blue color lamp 67 is switched on and the red original lamp 68 is switched off (return to ST1).

Further, as shown by FIG. 13, when ink supplied to the printing drum 2A (first printing drum) is not blue color but red color (ST71-No), the blue original lamp 67 is switched off and the red original lamp 68 is switched on (ST73). Thereby, the operator sets red original used in initial stencil making to reading means in accordance with instruction of the red original lamp 68. Further, as shown by FIG. 7, when the stencil making start key 63 is depressed (ST11-Yes), the operation proceeds to two color stencil making operation (ST12). Thereafter, the stencil making unit (frame 6) is moved to the side of the printing drum 2A (first printing drum) and stencil making and setting operation with respect to red original is carried out at the printing drum 2A (first printing drum).

Successively, as shown by FIG. 14, when ink supplied to the printing drum 2B (second printing drum) is blue color (ST77-No), the red original lamp 68 is switched off and the blue original lamp 67 is switched on (ST79). Thereby, the operator sets red original used in stencil making of a second color to reading means in accordance with instruction of the blue original lamp 67. Further, when the stencil making start key 63 is depressed (ST80-Yes), the stencil making unit (frame 6) is moved to the side of the printing drum 2B (second printing drum) (ST81) and stencil making and setting operation with respect to blue color is carried out at printing drum 2B (second printing drum).

Successively, by depressing the print start key 64, print sheet is transferred to the printing drum 2A (first printing drum). And printing operation by red color ink supplied to the printing drum 2A is carried out with respect to the print sheet. Successively, print sheet is transferred to the printing drum 2B (second printing drum) via the transfer means 40. And printing operation by blue color supplied to the printing drum 2B is carried out with respect to the print sheet.

In this way, according to the stencil printing machine of the first embodiment, by making the stencil making unit for stencil making stencil sheet S movable to the plurality of printing drums 2A and 2B, there are dispensed with respective transfer paths and transfer roller pairs for transferring stencil sheet S to the respective printing drums 2A and 2B and a switch mechanism for selecting the respective transfer paths. Thereby, constituent parts for transferring stencil sheet S are reduced.

Further, since respective transfer paths and transfer roller pairs are not provided, meandering is not caused in transferring stencil sheet S and accordingly, positions of attaching stencil sheet S to the respective printing drums 2 become predetermined positions and failure in attaching positions and wrinkle of stencil sheet S are eliminated.

Further, since respective transfer paths and transfer roller pairs are not provided, stencil sheet S is not clogged between upper and lower guide plates constituting the transfer path and folding is not caused at the front end of the stencil sheet S.

Therefore, according to the stencil printing machine of the first embodiment, there is provided the printing drum information detecting means for detecting ink colors supplied to the respective printing drums 2A and 2B. And in correspondence with the printing drum information from the printing drum information detecting means, there is displayed stencil making instruction information for expediting the operator with respect to in which color original to be printed is set to reading means. Accordingly, there is no drawback of setting erroneously original having different color to reading means for the operator. And perforation and setting of stencil sheet in correspondence with each of the printing drums 2A and 2B can be carried out.

Further, since the frame 6 (stencil making unit) is moved to the respective printing drums 2A and 2B. Accordingly, the control with regard to perforation of the printing sheet S by the stencil making unit can be made uniform and the control can be simplified.

Further, by moving the frame 6 (stencil making unit) to the middle position (initial position) substantially at equal interval from the respective printing drums 2A and 2B, the movement distance of the frame 6 can be made uniform to either of the printing drums 2A and 2B. And in selecting the respective printing drums 2A and 2B, the stencil making unit can be moved swiftly. Therefore, the control of moving the frame 6 becomes simple control with initial position as a reference.

Figure 15:
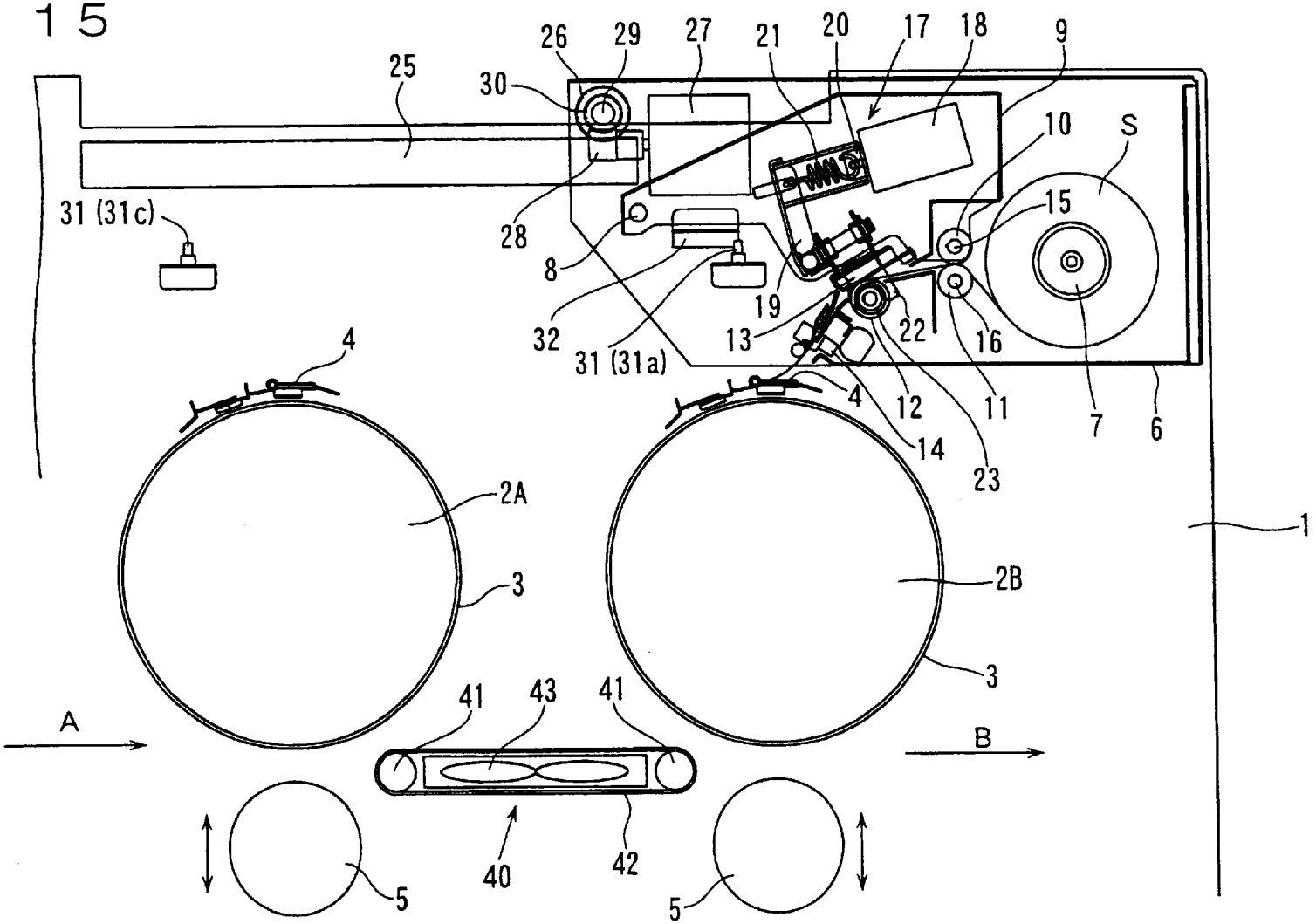
FIG. 15 is a side view showing a second embodiment of a stencil printing machine according to the present invention.
Figure 16:
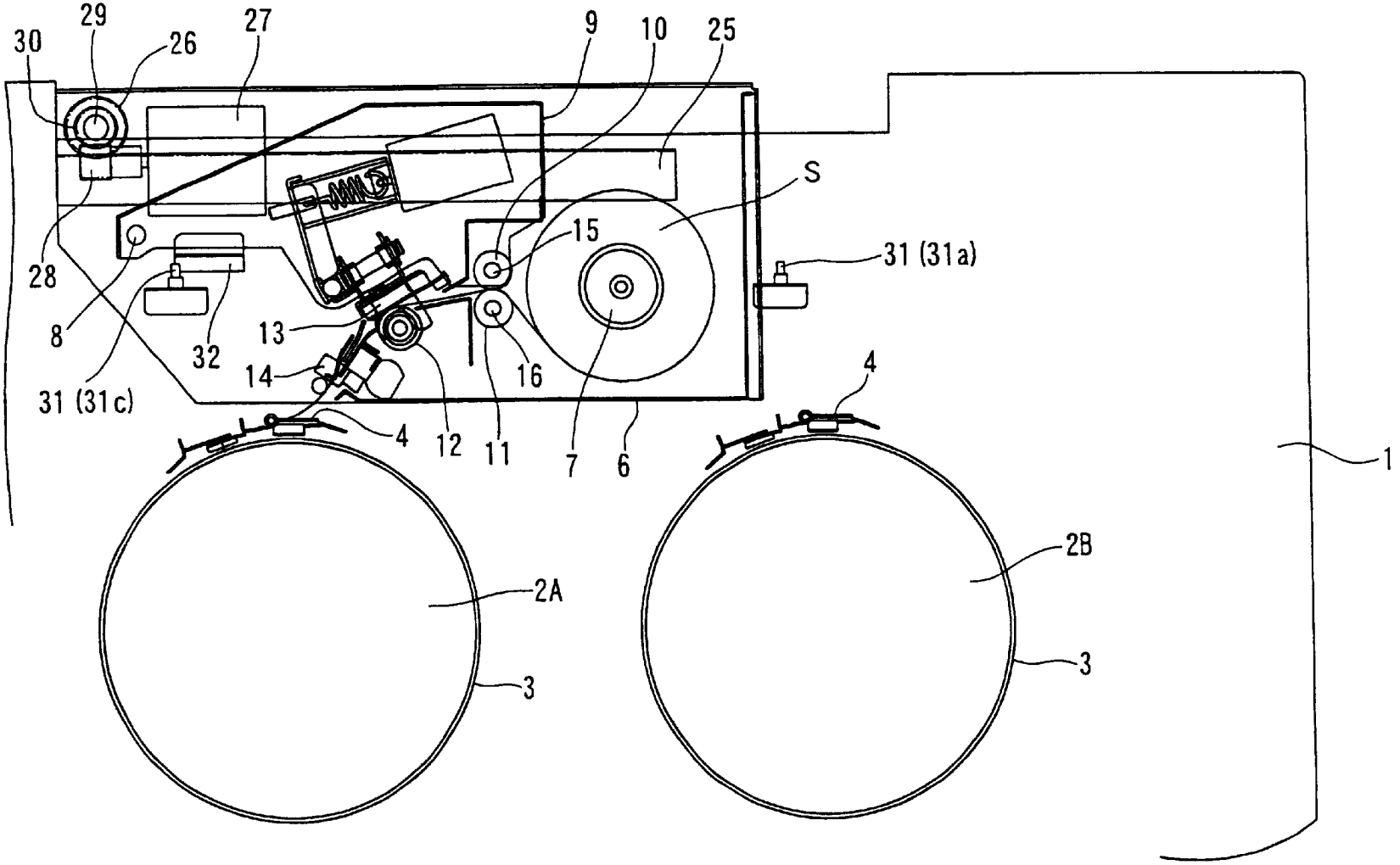
FIG. 16 is a side view showing operation of a stencil making apparatus according to the stencil printing machine.

An explanation will be given of a second embodiment according to the present invention in reference to the drawings as follows. FIG. 15 is a side view showing a second embodiment of a stencil printing machine according to the present invention. FIG. 16 is a side view showing operation of a stencil making apparatus according to the stencil printing machine.

Further, in the second embodiment explained below, with regard to constitutions the same as or equivalent to those in the above-described first embodiment, the same notations are attached and an explanation thereof will be omitted.

According to the second embodiment, as shown by FIG. 15, position detecting means is constituted by the position sensors 31 provided at positions for detecting that the frame 6 is moved to positions for delivering the end portion of perforated stencil sheet S to the two printing drums 2A and 2B and the shield plate 32 for shielding light projecting and receiving portions of the positions sensors 31.

That is, according to the embodiment, positions of stopping the frame 6 are constituted by two locations constituting the positions for delivering stencil sheet S respectively to the printing drum 2A and the printing drum 2B. The frame 6 is on standby by at either of the positions.

Figure 17A:
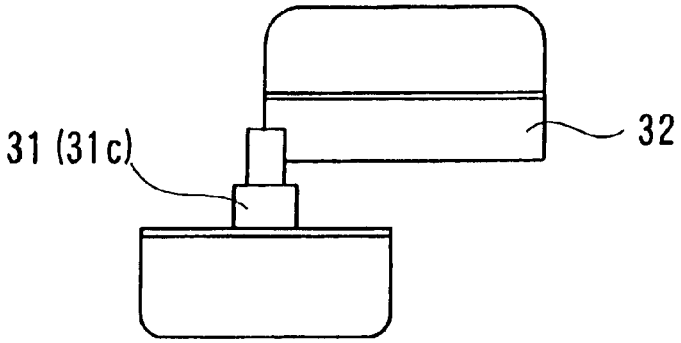
FIGS. 17(*a*) and 17(*b*) are side views showing a relationship between position sensors and a shield plate.
Figure 17B:
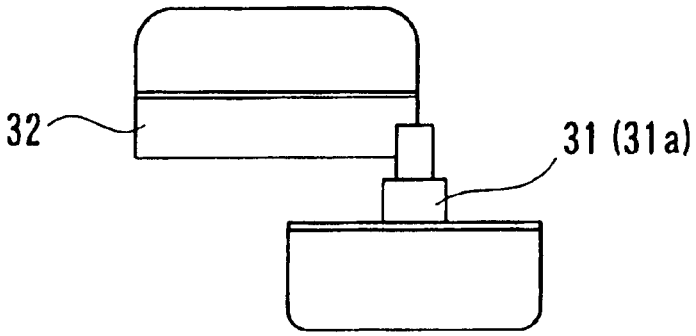

The relationship between the position sensor 31 and the shield plate 32 is as shown by FIG. 17(*a*) and FIG. 17(*b*). The shield plate 32 shields the light projecting and receiving portions of the respective position sensors 31 at both end portions thereof in accordance with movement of the frame 6.

Here, an explanation will be given of a specific relationship between the position sensors 31 and the shield plate 32 in accordance with movement of the frame 6 in reference to FIG. 15 and FIG. 16. As shown by FIG. 15, when the frame 6 (stencil making unit) is disposed at the position for delivering stencil sheet S to the printing drum 2B, the position sensor 31*a* is shielded by the shield plate 32. In setting the stencil making unit to the position, the frame 6 is moved from a state in FIG. 16 in the right direction and movement of the frame 6 is stopped at a position at which the position sensor 31*a* is shielded by the shield plate 32.

Further, as shown by FIG. 16, when the frame 6 (stencil making unit) is disposed at the position for delivering stencil sheet S to the printing drum 2A, the position sensor 31*c* is shielded by the shield plate 32. In setting the stencil making unit to the position, the frame 6 is moved from a state in FIG. 15 in the left direction and movement of the frame 6 is stopped at a position at which the position sensor 31*c* is shielded by the shield plate 32.

In this way, according to the stencil printing machine for carrying out stencil making and setting operation to the plurality of printing drums 2A and 2B by the single stencil making apparatus, it is necessary to carry out stencil making operation in correspondence with the respective printing drums 2A and 2B on the side of the stencil making apparatus and setting (transferring) perforated stencil sheet S in correspondence with the respective printing drums 2A and 2B. According to the stencil printing machine of the invention, there is provided the printing drum information detecting means for detecting printing drum information of in which ink colors the respective printing drums 2A and 2B are set, particularly when the printing drums 2A and 2B are set to different colors and printing of different colors is carried out to printing sheet.

The printing drum information detecting means for detecting the printing drum information is constituted similar to that of the above-described first embodiment.

An explanation will be given of control means for transmitting the printing drum information from the printing drum information detecting means as follows. The control means generally controls all of operation of the stencil printing machine including movement of the above-described stencil making unit (frame 6).

Figure 18:
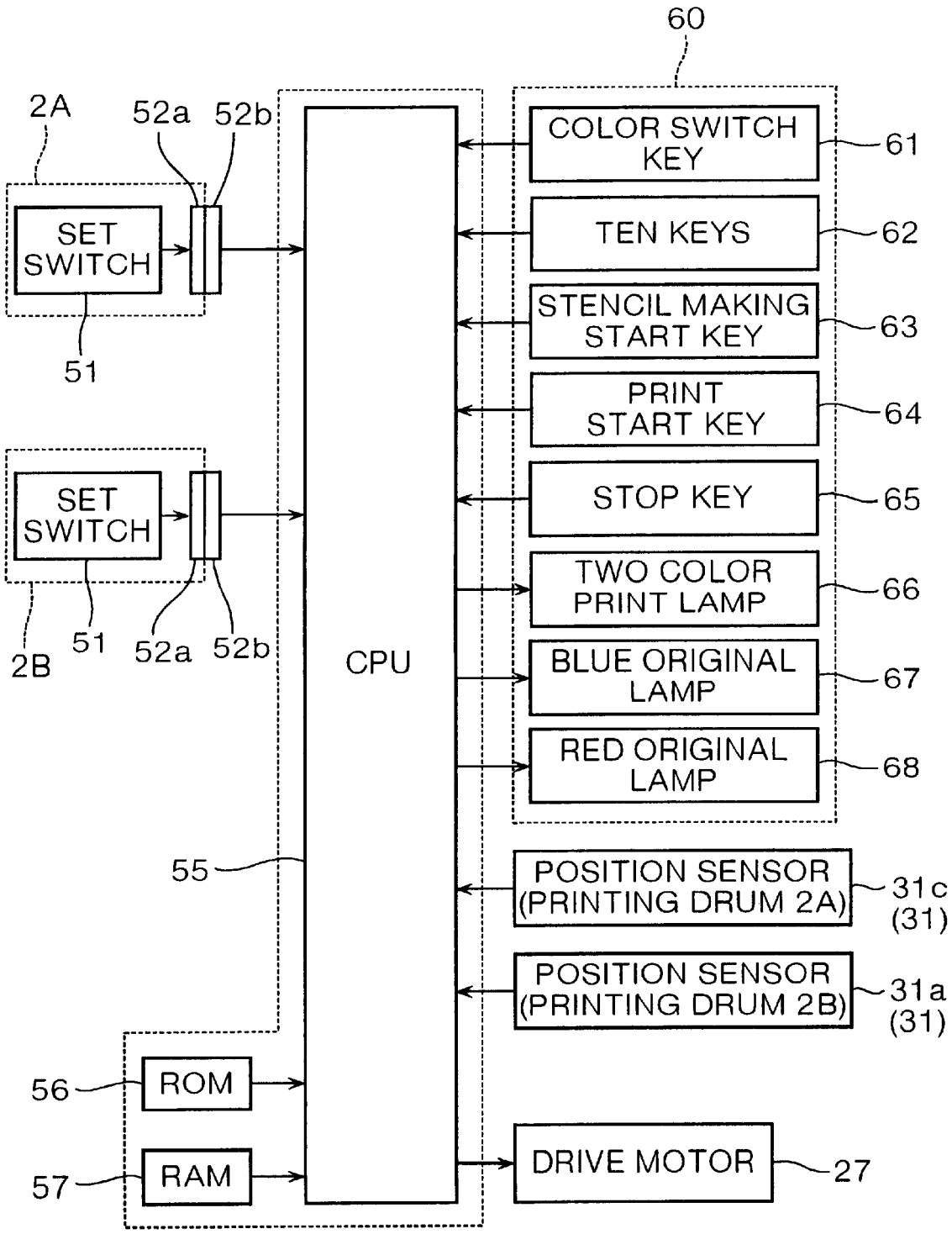
FIG. 18 is a block diagram showing control means of the stencil printing machine.

As shown by FIG. 18, the control means is constituted as a one chip microcomputer including CPU 55 constituted by a microprocessor, ROM 56 stored with programs for controlling respective mechanisms in the stencil printing machine and RAM 57 for storing operation results of the microprocessor and various input information as necessary.

The control means inputs various key information from the operation panel 60 arranged at the upper face of the cabinet of the stencil printing machine, ON/OFF information of the respective position sensors 31 and printing drum information by the set switches 51 and 53 and holds them in RAM 57.

CPU 55 determines an efficient order of stencil making and setting operation in accordance with inputted information and displays instruction to the operator on the operation panel 60.

As shown by FIG. 6, the operation panel 60 is provided with various keys of the color switch key 61, the ten keys 62, the stencil making start key 63, the print start key 64 and the stop key 65.

The color switch key 61 is a key for selectively switching whether two color printing is carried out or single color printing is carried out and selectively switching color perforated in the case of single color printing, that is, to which of the printing drums 2A and 2B, stencil sheet set thereto is perforated. The color switch key 61 is switched in the order of two color printing, single blue color printing, single red color printing, two color printing . . . at every time of depressing thereof (when the printing drums 2A and 2B are respectively set to blue color ink and red color ink).

The ten keys are constituted by numeral keys of 0 through 9 for setting a number of print sheets.

The stencil making start key 63 is operated to depress in executing stencil making and setting operation after setting the color switch key 61 or the ten keys 62.

The print start key 64 is operated to depress in executing printing operation after stencil making operation. Further, the stop key 65 is operated to depress in stopping operation in the printing operation.

Further, the operation panel 60 is arranged with displaying means. Various information of the stencil printing machine is displayed at the displaying means. As shown by FIG. 6, there are the two color print lamp 66 and the original lamps 67 and 68 in the display means according to the embodiment.

The two color print lamp 66 is switched on or switched off by switching the color switch key 61. The two color print lamp 66 according to the embodiment is switched on in switching to the two color print mode and switched off in switching to the single color (blue color, red color) printing mode.

The original lamps 67 and 68 are switched on or switched off in correspondence with display for expediting the operator with respect to in which color original printed thereby is set to reading means in correspondence with the printing drum information. Specifically, in the case of the single color print mode, one in correspondence with the switched color is switched on. Further, in the case of two color print mode, the operator is expedited with respect to in which color of stencil making is successively carries out. And one in correspondence with the color is switched on in order to make the operator set original of the color to reading means. Further, according to the embodiment, the printing drums 2A and 2B are supplied with ink of blue color and red color and set such that printing by ink colors of blue color and red color can be carried out. The original lamp 67 constitutes a blue original lamp and the original lamp 68 constitutes a red original lamp.

In this way, the displaying means is displayed with stencil making instruction information for expediting the operator with respect to which original is set to reading means in correspondence with the printing drum information of the respective printing drums 2A and 2B detected by the printing drum information detecting means.

Figure 19:
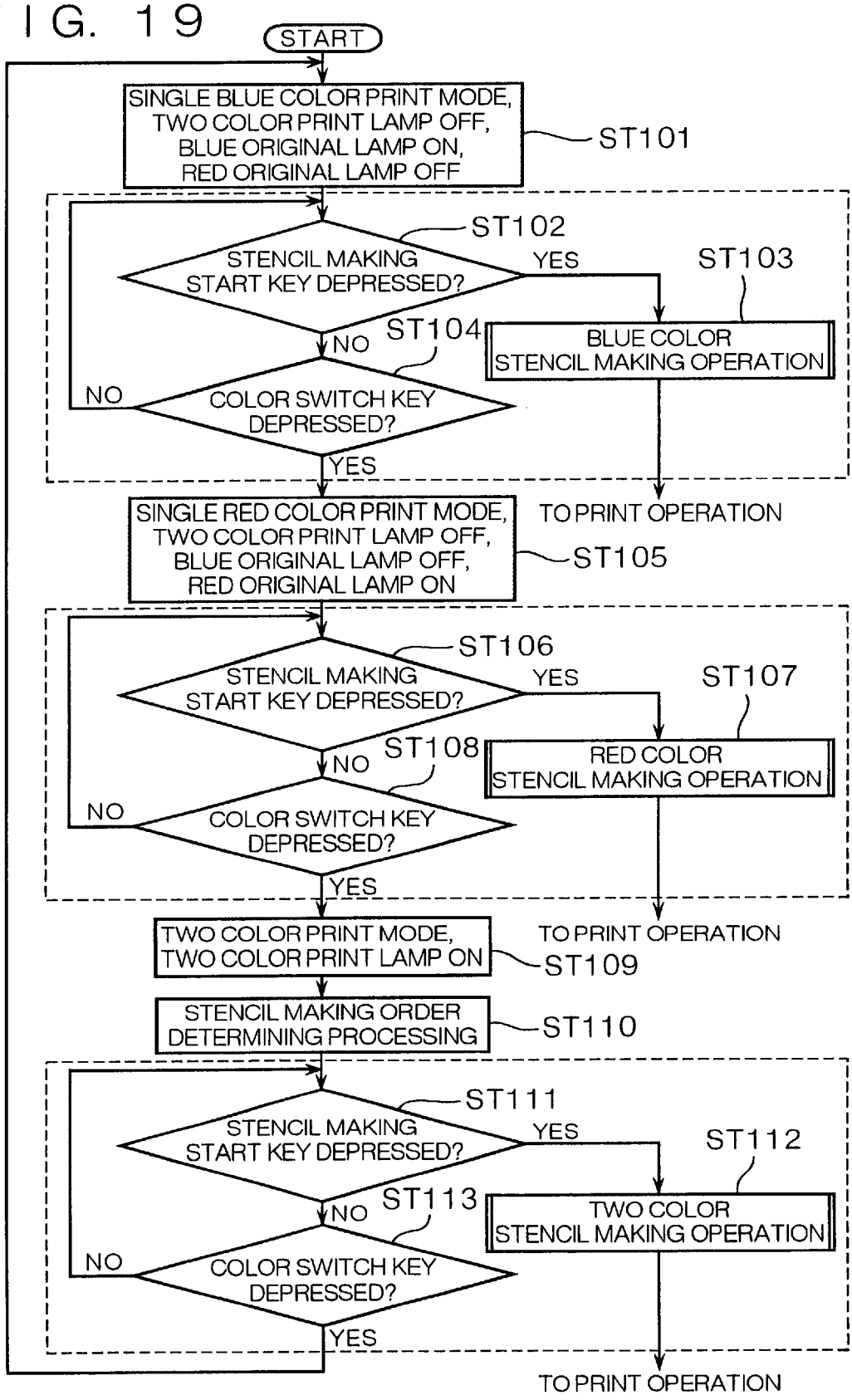
FIG. 19 shows a control flow indicating print mode switching operation.

An explanation will be given of respective control operation in the second embodiment as follows. FIG. 19 shows a control flow with regard to print mode switching operation of the stencil printing machine. In the control flow, the operation is in single blue color print mode when the operation is started, only the blue color original lamp 67 is brought into a switched on state and the red original lamp 68 and the two color print lamp 66 are brought into a switched off state (ST101).

At this occasion, the operator sets blue original used for stencil making to reading means in accordance with instruction of the blue original lamp 67 when the single blue color printing is carried out.

Next, it is confirmed whether the stencil making start key 63 is depressed and when the stencil making start key 63 is depressed (ST102-Yes), the operation proceeds to blue color stencil making operation (ST103).

Figure 20:
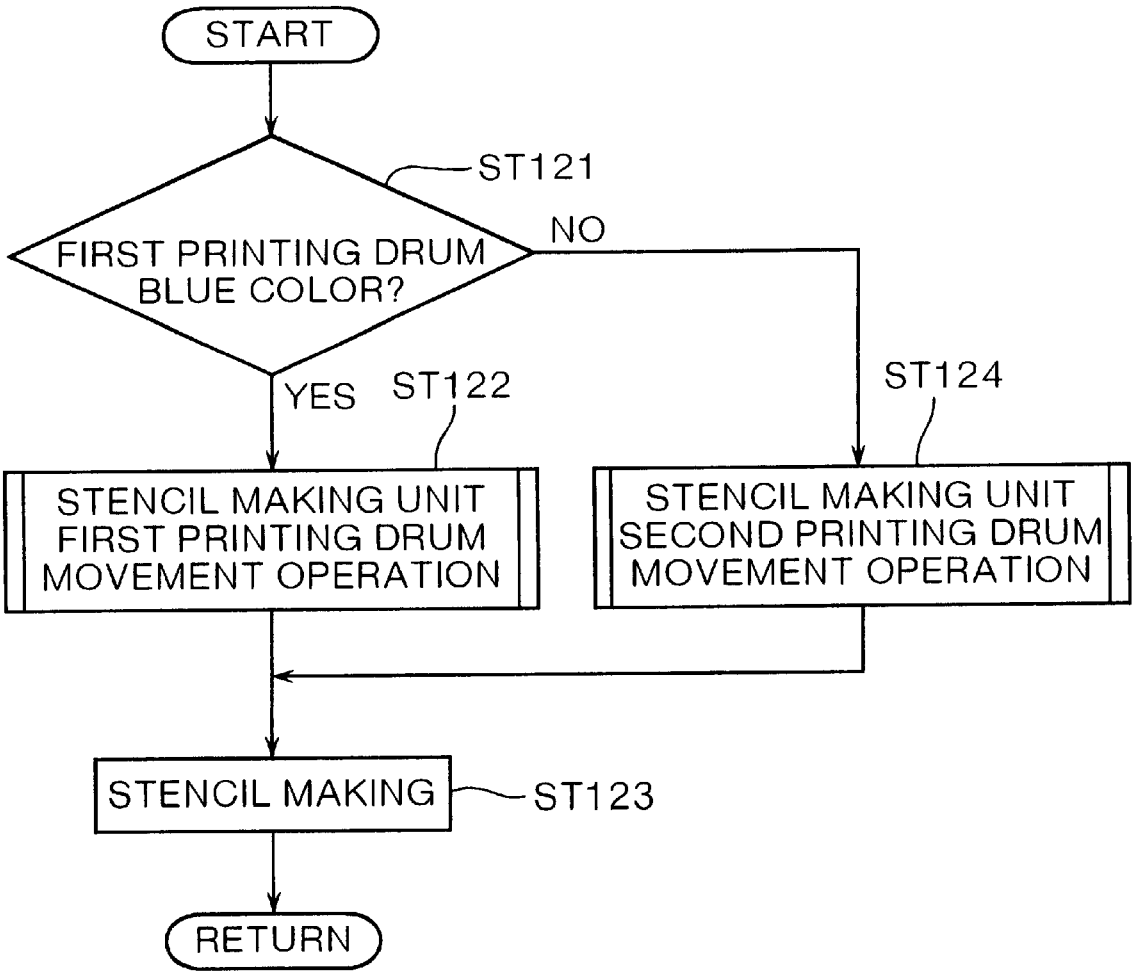
FIG. 20 shows a control flow indicating blue color stencil making operation.

FIG. 20 shows a control flow of blue color stencil making operation. First, it is determined whether ink supplied to the printing drum 2A (first printing drum) is blue color by information transmitted by the printing drum information detecting means. When ink supplied to the printing drum 2A (first printing drum) is blue color (ST121-Yes), the frame 6 constituting the stencil making unit is moved to the side of the printing drum 2A (first printing drum) (ST122).

Figure 21:
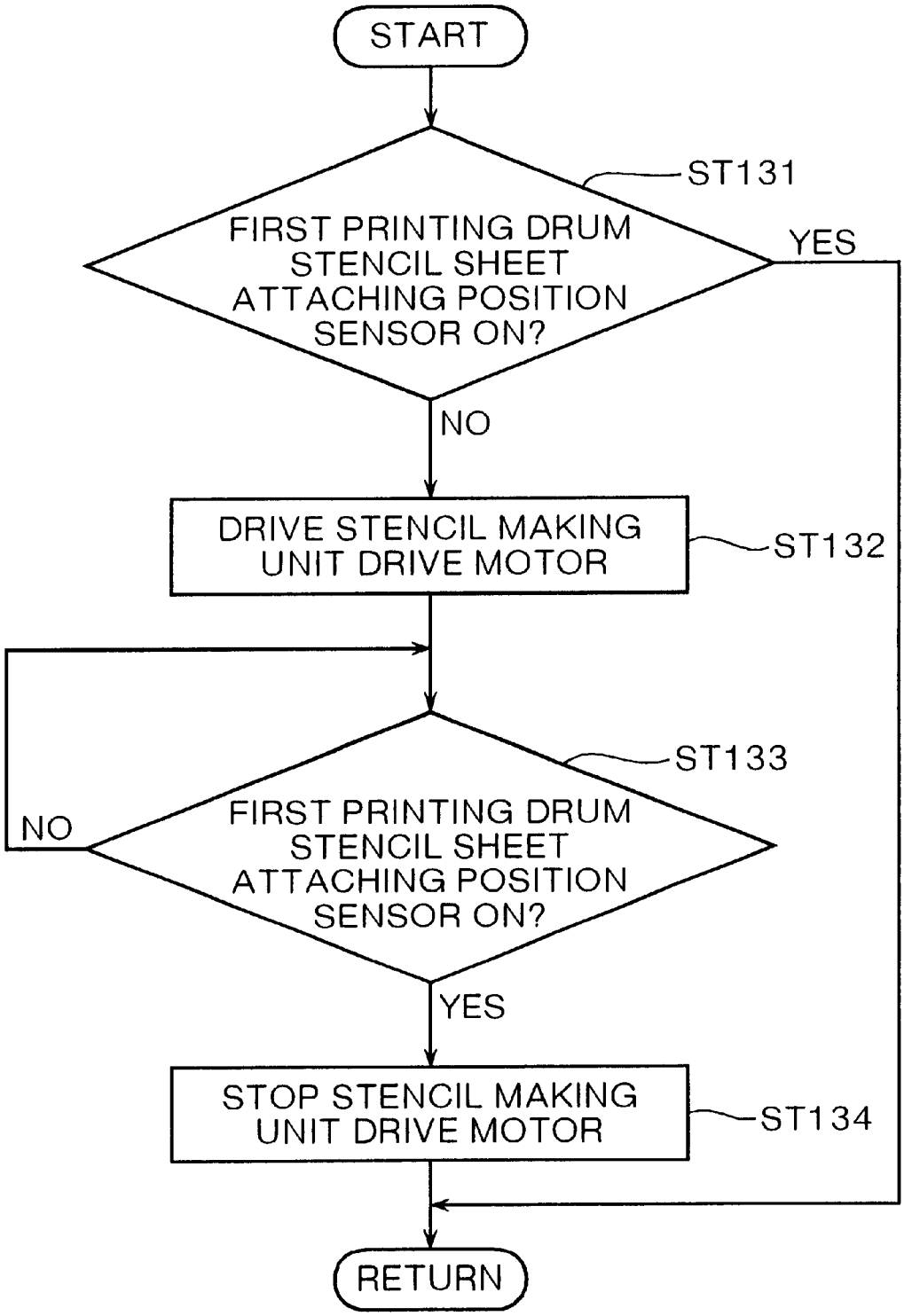
FIG. 21 shows a control flow indicating operation of moving a stencil making unit to a first printing drum side.

FIG. 21 shows a control flow of operation of moving the stencil making unit to the side of the printing drum 2A (first printing drum). First, it is determined whether the frame 6 (stencil making unit) is disposed at the first printing drum stencil sheet attaching position for attaching stencil sheet S to the printing drum 2A (first printing drum) by information transmitted by the position detecting means. When the stencil making unit is not disposed at the first printing drum stencil sheet attaching position (ST131-No), that is, the stencil making unit is disposed at the second printing drum stencil sheet attaching position, the drive motor 27 provided at the frame 6 constituting the stencil making unit is driven and the frame 6 is moved from the second printing drum stencil sheet attaching position in the direction of the printing drum 2A (first printing drum) (ST132). While the frame 6 is not disposed at the first printing drum stencil sheet attaching position, the frame 6 continues moving by the drive motor 27 (ST132-No). Further, when the frame 6 is disposed at the first printing drum stencil sheet attaching position (ST132-Yes), the drive motor 27 is stopped and movement of the frame 6 is stopped (ST134).

Meanwhile, as shown by FIG. 21, at ST131, when the stencil making unit is disposed at the first printing drum stencil sheet attaching position (ST131-Yes), the stencil making unit does not carry out moving operation and stays as it is and proceeds to successive processing.

Thereafter, as shown by FIG. 20, there is carried out stencil making and setting processing with regard to blue original at the printing drum 2A (first printing drum) by the stencil making apparatus (ST123).

When stencil making and setting operation has been finished, by depressing the print start key 64, print sheet is transferred to the printing drum 2A (first printing drum) and there is carried out printing operation by blue color ink with respect to the print sheet.

Further, as shown by FIG. 20, when ink supplied to the printing drum 2A (first printing drum) is not blue color at ST121 (ST121-No), the frame 6 constituting the stencil making unit is moved to the side of the printing drum 2B (second printing drum) (ST124).

Figure 22:
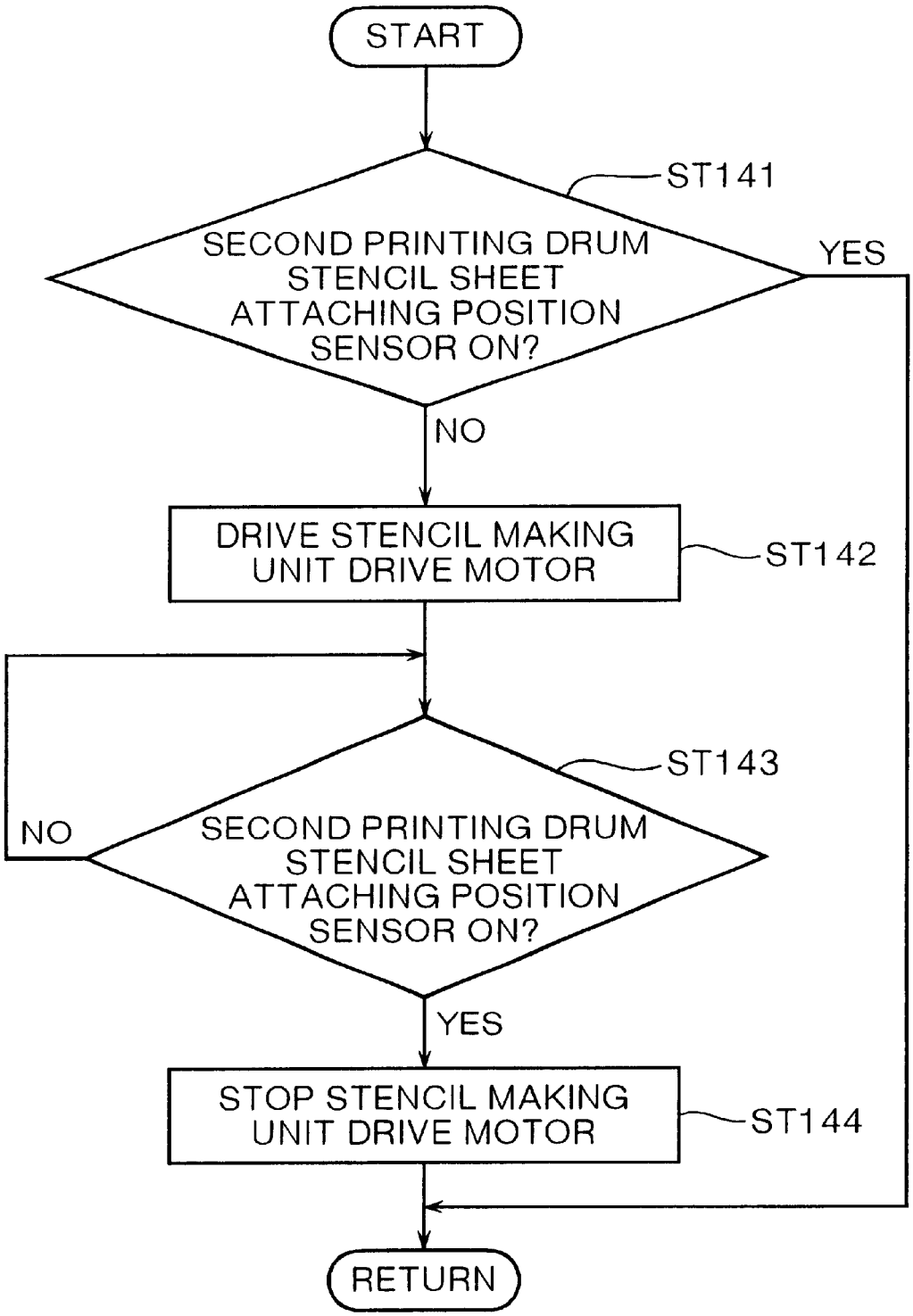
FIG. 22 shows a control flow indicating operation of moving the stencil making unit to a second printing drum side.

FIG. 22 shows a control flow of operation of moving the stencil making unit to the side of the printing drum 2B (second printing drum). First, it is determined whether the frame 6 (stencil making unit) is disposed at the second printing drum stencil sheet attaching position for attaching stencil sheet S to the printing drum 2B (second printing drum) by information transmitted by the position detecting means. When the stencil making unit is not disposed at the second printing drum stencil sheet attaching position (ST141-No), that is, when the stencil making unit is disposed at the first printing drum stencil sheet attaching position, the drive motor 27 provided at the frame 6 constituting the stencil making unit is driven and the frame 6 is moved from the first printing drum stencil sheet attaching position in the direction of the printing drum 2B (second printing drum) (ST142). While the frame 6 is not disposed at the second printing drum stencil sheet attaching position, the frame 6 continues moving by the drive motor 27 (ST143-No). Further, when the frame 6 is disposed at the second printing drum stencil sheet attaching position (ST143-Yes), the drive motor 27 is stopped and movement of the frame 6 is stopped (ST144).

Meanwhile, as shown by FIG. 22, at ST 141, when the stencil making unit is disposed at the second printing drum stencil sheet attaching position (ST141-Yes), the stencil making unit does not carry out moving operation and stays as it is and proceeds to successive processing.

Thereafter, as shown by FIG. 20, there is carried out stencil making and setting processing with regard to blue original at the printing drum 2B (second printing drum) by the stencil making apparatus (ST123).

When stencil making and setting operation has been finished, by depressing the print start key 64, print sheet is transferred to the printing drum 2B (second printing drum) and there is carried out printing operation by blue color ink with respect to the print sheet.

Further, as shown by FIG. 19, at ST102, when depression of the stencil making start key 63 is not confirmed (ST102-No), it is confirmed whether the color switch key 61 is depressed. When the depression is not confirmed (ST104-No), the operation proceeds to a state of confirming depression of the stencil making start key 63 again (return to ST102). In contrast thereto, when depression of the color switch key 61 is confirmed (ST104-Yes), the operation proceeds to single red color print mode (ST105). At this occasion, the red original lamp 68 is switched on, the blue original lamp 67 is switched off. And the two color print lamp 63 is brought into a switched off state continuously.

Successively, as shown by FIG. 19, in the single red color print mode, depression of the stencil making start key 63 is confirmed (ST106). The operator sets red original used for perforation to reading means in accordance with instruction of the red original lamp 68 when single red color printing is carried out. Further, when the stencil making start key 63 is depressed (ST106-Yes), the operation proceeds to red color stencil making operation (ST107).

Figure 23:
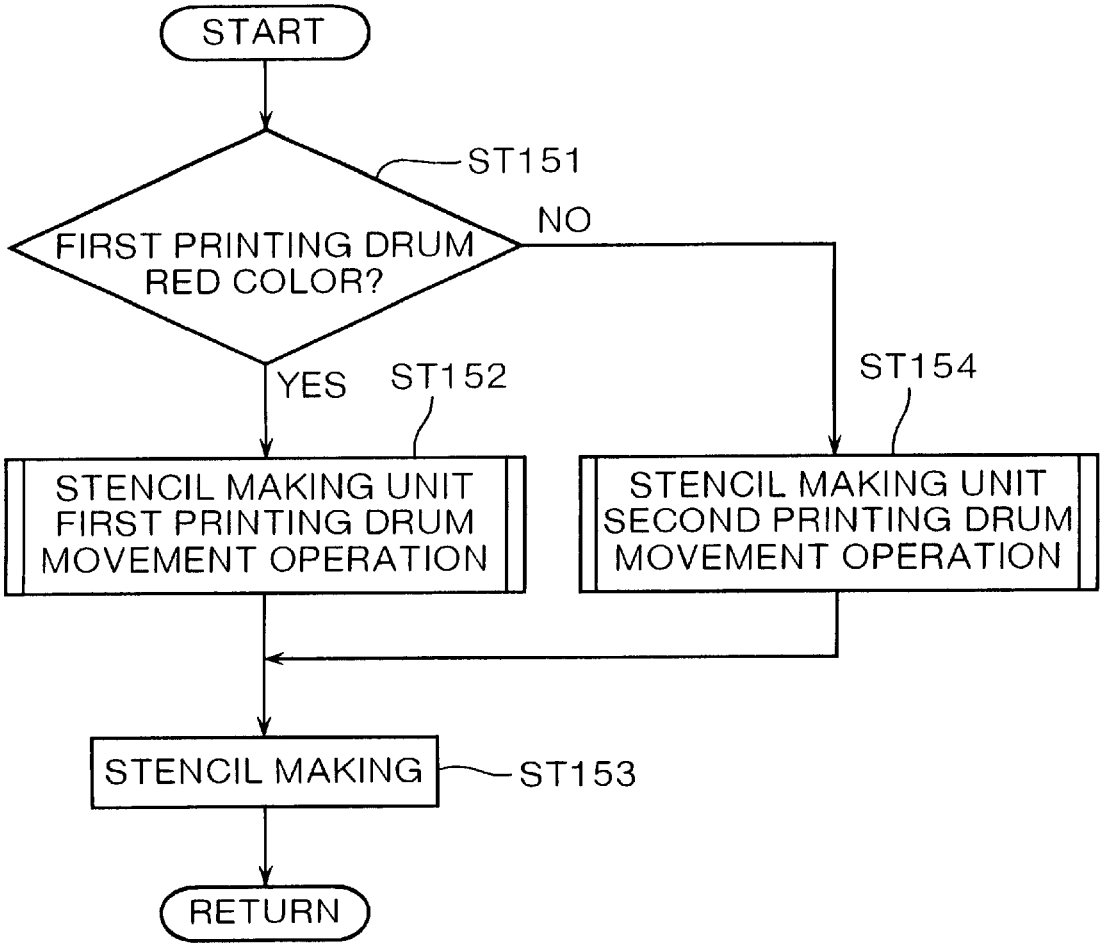
FIG. 23 shows a control flow indicating red color stencil making operation.

FIG. 23 shows a control flow of red color stencil making operation. First, it is determined whether ink supplied to the printing drum 2A (first printing drum) is red color by information transmitted from the printing drum information detecting means. When ink supplied to the printing drum 2A (first printing drum) is red color (ST151-Yes), the frame 6 constituting the stencil making unit is moved to the side of the printing drum 2A (first printing drum) (ST152). Movement of the frame 6 to the side of the printing drum (first printing drum) is shown in FIG. 21 similar to the above.

Thereafter, as shown by FIG. 23, there is carried out stencil making and setting processing with regard to red original at the printing drum 2A (first printing drum) by the stencil making apparatus (ST153).

When stencil making and setting operation has been finished, by depressing the print start key 64, print sheet is transferred to the printing drum 2A (first printing drum) and there is carried out printing operation by red color ink with respect to the print sheet.

Further, as shown by FIG. 23, when ink supplied to the printing drum 2A (first printing drum) is not red color at ST151 (ST151-No), the frame 6 constituting the stencil making unit is moved to the side of the printing drum 2B (second printing drum) (ST154). Movement of the frame 6 to the side of the printing drum 2B (second printing drum) is shown in FIG. 22 similar to the above.

Thereafter, as shown by FIG. 23, there is carried out stencil making and setting processing with respect to red original at the printing drum 2B (second printing drum) by the stencil making apparatus (ST153).

When stencil making and setting operation has been finished, by depressing the print start key 64, print sheet is transferred to the printing drum 2B (second printing drum) and there is carried out printing operation by red color ink with respect to the print sheet.

Further, as shown by FIG. 19, when depression of stencil making start key 63 is not confirmed at ST106 (ST106-No), depression of the color switch key 61 is confirmed (ST108). When depression of the color switch key 61 is not confirmed (ST108-No), the operation proceeds to a state of confirming depression of the stencil making start key 63 again (return to ST106). In contrast thereto, when depression of the color switch key 61 is confirmed (ST108-Yes), the operation proceeds to two color print mode and the two color print lamp 66 is switched on (ST109).

Here, in carrying out two color printing, there is carried out stencil making order determining processing for determining ink colors supplied to the printing drum 2A (first printing drum) and the printing drum 2B (second printing drum) and stencil making order of the printing drum 2A (first printing drum) and the printing drum (second printing drum) (ST110).

Figure 24:
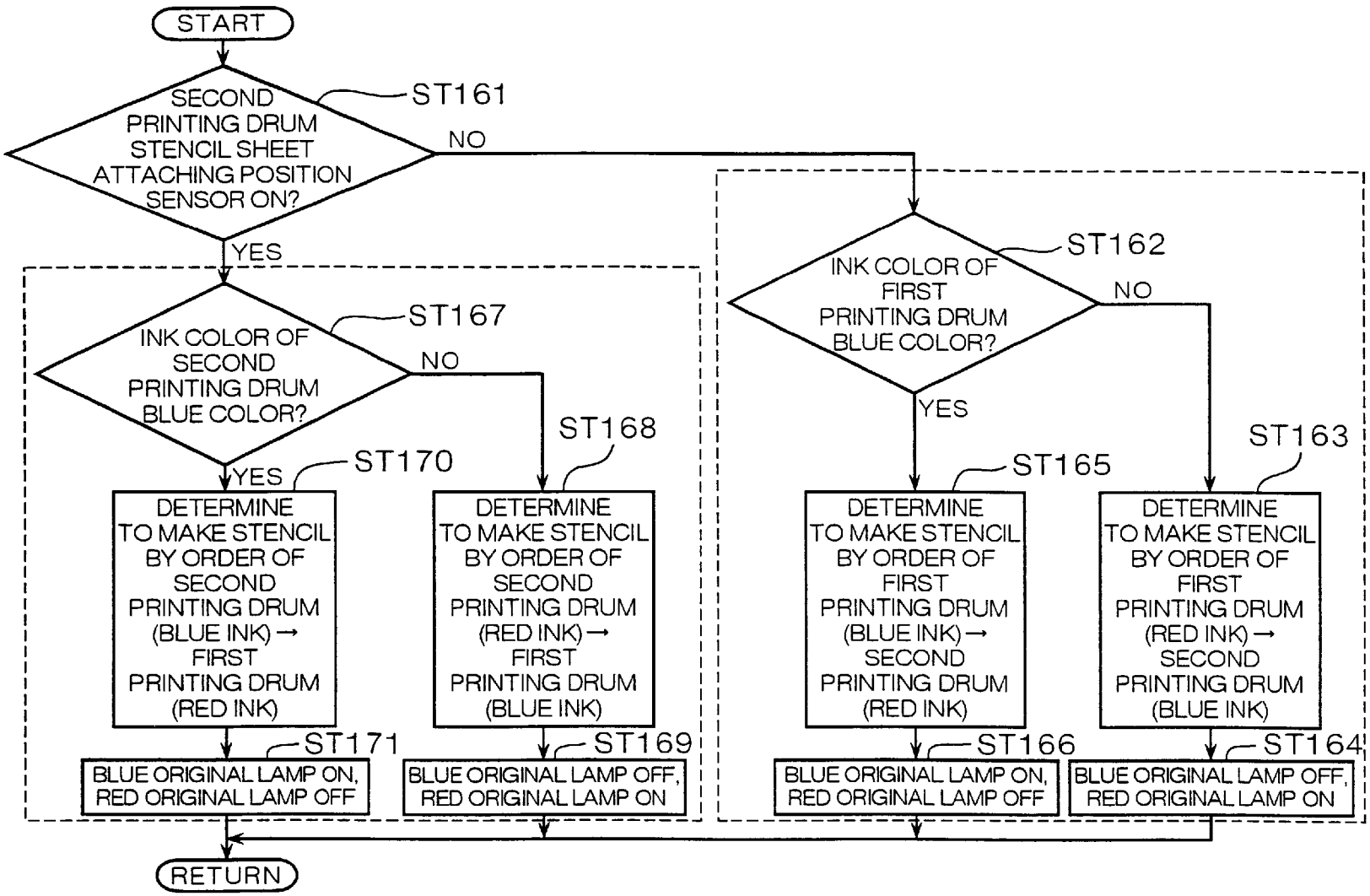
FIG. 24 shows a control flow indicating a processing of determining a stencil making order.

FIG. 24 shows a control flow indicating a processing of determining stencil making order. First, it is determined whether the stencil making unit is disposed at the second printing drum stencil sheet attaching position by information transmitted by the position detecting means.

When the stencil making unit is not disposed at the second printing drum stencil sheet attaching position (ST161-No), that is, when the stencil making unit is disposed at the first printing drum stencil sheet attaching position, successively, ink color supplied to the printing drum 2A (first printing drum) is determined by information transmitted by the printing drum information detecting means.

When ink supplied to the printing drum 2A (first printing drum) is red color (ST160-No), the stencil making order is determined in an order of the printing drum 2A (first printing drum)→the printing drum 2B (second printing drum) (ST163), further, the blue original lamp 67 is switched off and the red original lamp 68 is switched on (ST164). The stencil making order is defined as pattern 1.

Meanwhile, at ST162, when ink supplied to the printing drum 2A (first printing drum) is blue color (ST162-Yes), the stencil making order is determined in an order of the printing drum 2A (first printing drum)→the printing drum 2B (second printing drum) (ST165), further, the blue original lamp 67 is switched on and the red original lamp 68 is switched off (ST166). The stencil making order is defined as pattern 2.

Further, at ST 161, when the stencil making unit is disposed at the second printing drum stencil sheet attaching position (ST161-Yes), successively, ink color supplied to the printing drum 2B (second printing drum) is determined by information transmitted from the printing drum information detecting means.

When ink supplied to the printing drum 2B (second printing drum) is red color (ST167-No), the stencil making order is determined in an order of the printing drum 2B (second printing drum)→the printing drum 2A (first printing drum) (ST168), further, the blue original lamp 67 is switched off and the red original lamp 68 is switched on (ST169). The stencil making order is defined as pattern 3.

Meanwhile, at ST167, when ink supplied to the printing drum 2B (second printing drum) is blue color (ST167-Yes), the stencil making order is determined in an order of the printing drum 2B (second printing drum)→the printing drum 2A (first printing drum) (ST170), further, the blue original lamp 67 is switched on and the red original lamp 68 is switched off (ST171). The stencil making order is defined as pattern 4.

Successively, as shown by FIG. 19, in the two color print mode, depression of the stencil making start key 63 is confirmed (ST111). The operator sets blue original or red original used in initial stencil making to reading means in accordance with instruction of the blue original lamp 67 or the red original lamp 68 when two color printing is carried out. Further, when the stencil making start key 63 is depressed (ST111-Yes), the operation proceeds to two color stencil making operation (ST112).

Further, instruction of switching on the blue original lamp 67 or the red original lamp 68 is determined by the above-described patterns 1 through 4. In pattern 1, the stencil making unit is disposed on the side of the printing drum 2A (first printing drum) supplied with red ink. Accordingly, the red original lamp 68 is switched on. In pattern 2, the stencil making unit is disposed on the side of the printing drum 2A (first printing drum) supplied with blue ink and accordingly, the blue original lamp 67 is switched on. In pattern 3, the stencil making unit is disposed on the side of the printing drum 2B (second printing drum) supplied with red ink. Accordingly, the red original lamp 68 is switched on. In pattern 4, the stencil making unit is disposed on the side of the printing drum 2B (second printing drum) supplied with blue ink. Accordingly, the blue original lamp 67 is switched on.

Figure 25:
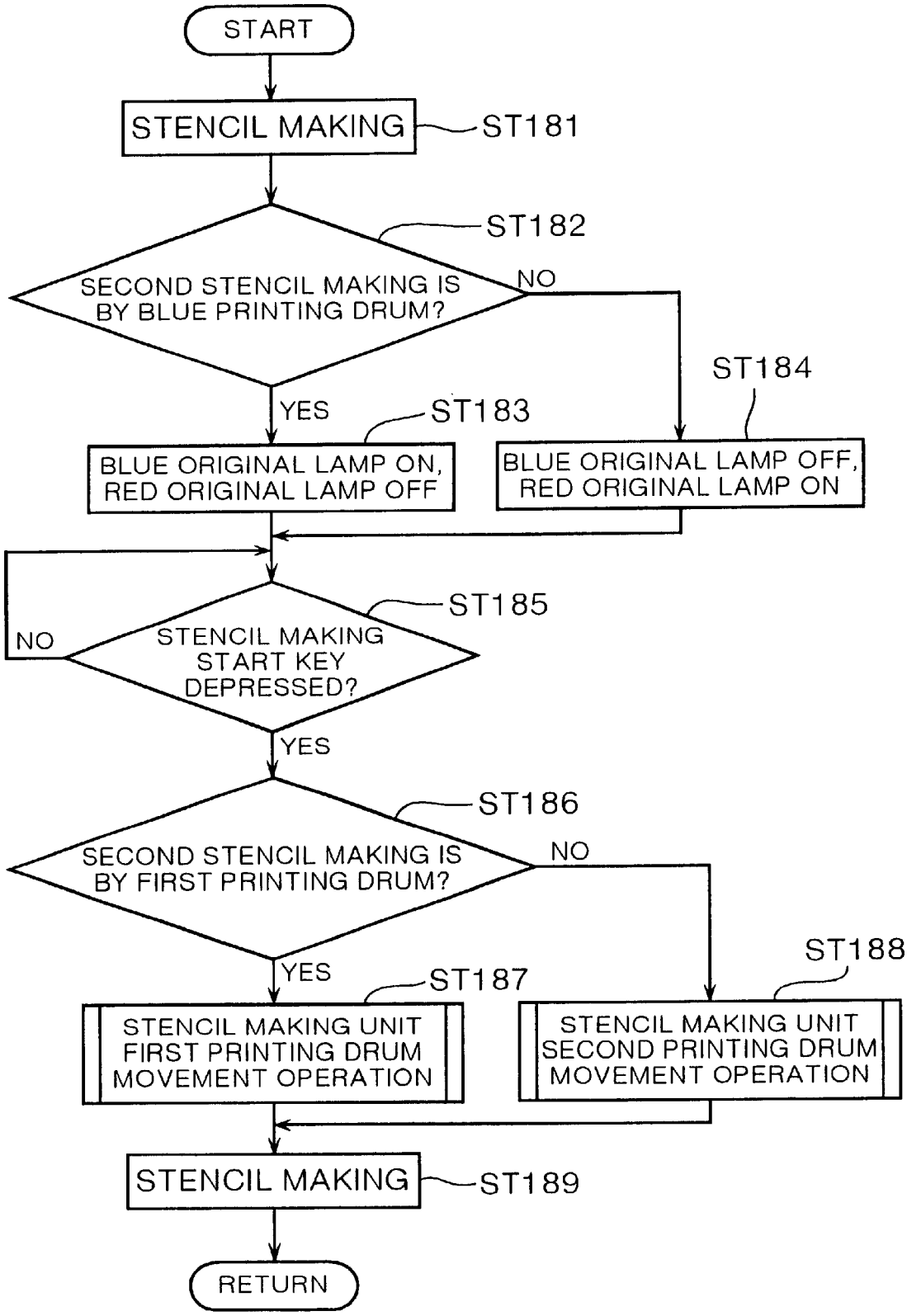
FIG. 25 shows a control flow indicating two color stencil making operation.
Figure 26:
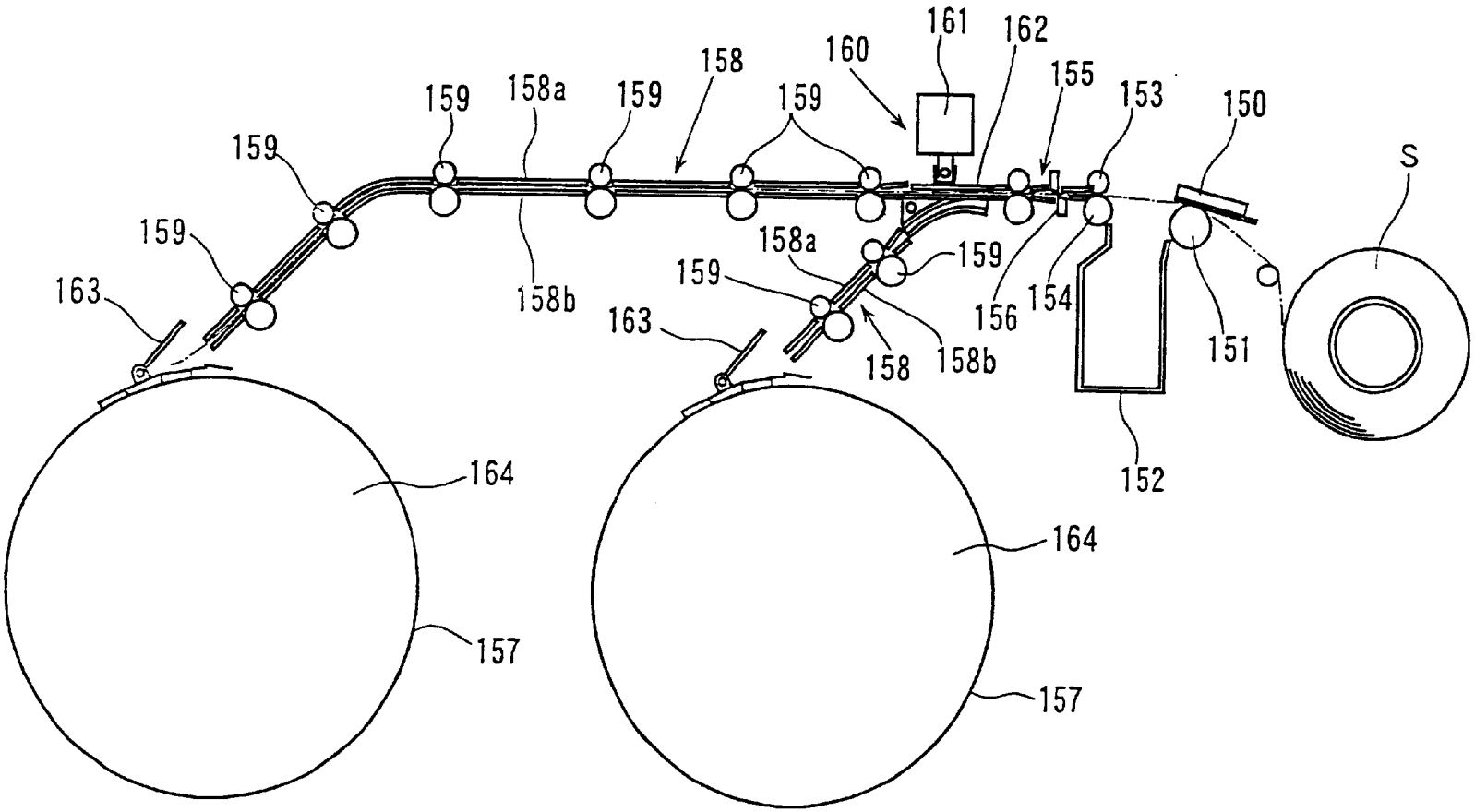
FIG. 26 Prior Art
FIG. 26 is a side view showing a conventional stencil printing machine.

FIG. 25 shows a control flow of two color stencil making operation. First, by the stencil making order determined by the above-described stencil making order determining processing, stencil making and setting processing is carried out with respect to the first printing drum 2A (2B) (ST181).

Next, ink color for carrying out stencil making and setting operation at the second color is determined by the stencil making order determined by the stencil making order determining processing. When ink of the second color is blue color (ST182-Yes), the blue original lamp 67 is switched on and the red original lamp 68 is switched off (ST183). Further, when ink of the second color is red color (ST182-No), the blue original lamp 67 is switched off and the red original lamp 68 is switched on (ST 184).

Thereafter, the operator sets blue original or red original used in perforation of the second color to reading means in accordance with instruction of the blue original lamp 67 or the red original lamp 68. Further, when the stencil making start key 63 is depressed (ST185-Yes), stencil making operation of the second color is started.

First, by the stencil making order determined by the stencil making order determining processing, the printing drum 2 for carrying out stencil making and setting operation of the second color is determined. When the second color is for the printing drum 2A (first printing drum) (ST186-Yes), the frame 6 is moved from the second printing drum stencil sheet attaching position to the first printing drum stencil sheet attaching position (ST187). At this occasion, control of movement operation follows control flow of movement operation to the printing drum 2A (first printing drum) shown in FIG. 21, mentioned above. Further, when the second color is for the printing drum 2B (second printing drum) (ST186-No), the frame 6 is moved from the first printing drum stencil sheet attaching position to the second printing drum stencil sheet attaching position (ST188). At this occasion, control of movement operation follows control flow of movement operation to the side of the printing drum 2B (second printing drum) shown in FIG. 22, mentioned above.

Further, when movement to a position for delivering stencil sheet S to the printing drum 2A (2B) of the second color has been finished, stencil making and setting processing is carried out with respect to the printing drum 2A (2B) of the second color (ST189).

When stencil making and setting operation has been finished, by depressing the print start key 64, print sheet is transferred to the printing drum 2A (first printing drum) and the printing drum 2B (second printing drum) and two color printing operation by red color ink and blue color ink is carried out with respect to the print sheet.

Further, as shown by FIG. 19, at ST111, when depression of the stencil making start key 63 is not confirmed (ST111-No), depression of the color switch key 61 is confirmed (ST113). When depression of the color switch key 61 is not confirmed (ST113-No), the operation proceeds to the state of confirming depression of the operation start key 63 again (return to ST111). In contrast thereto, when depression of the color switch key 61 is confirmed (ST113-Yes), the print mode becomes single blue color print mode again, the two color print lamp 66 is switched off, the blue original lamp 67 is switched on and the red original lamp 68 is switched off (return to ST101).

Further, in the above-described single color and two color printing, after finishing to transfer (set) stencil sheet S to the respective printing drums 2A and 2B, the frame 6 (stencil making unit) is made to be on standby at the position of the printing drum 2A or 2B to which the frame 6 is finally transferred as it is for successive stencil making and setting operation.

In this way, according to the stencil printing machine of the second embodiment, the stencil making unit for stencil making stencil sheet S is made movable to the plurality of printing drums 2A and 2B. Thereby, constituent parts for transferring stencil sheet S are reduced. Further, according to the second embodiment, in comparison with the first embodiment, the stencil making unit (frame 6) is not stopped at the central position to thereby dispense with the central position sensor and accordingly, constituent parts are further reduced.

Further, respective transfer paths and transfer roller pairs are not provided and accordingly, meandering in transferring stencil sheet S is not caused. Accordingly, positions of attaching stencil sheet S to the respective printing drums 2A and 2B become predetermined positions. And failure in attaching position and wrinkle of stencil sheet S are eliminated. Further, since respective transfer paths and transfer roller pairs are not provided, stencil sheet S is not clogged between upper and lower guide plates constituting transfer paths and the front end of the stencil sheet S is not folded.

Therefore, according to the stencil printing machine of the above-described second embodiment, in moving the frame 6 (stencil making unit), the frame 6 (stencil making unit) is disposed on the side of either of the respective printing drums 2A and 2B and the stencil making unit is made to be on standby at a position at which stencil making and setting operation has been carried out finally. Further, current position of the stencil making unit is detected by the position detecting means. And ink color supplied to the printing drum 2A or 2B at which the stencil making unit is disposed is detected by the printing drum information detecting means. Further, setting of original of ink color supplied to the printing drum 2A or 2B at which the stencil making unit is currently disposed, is expedited to the operator.

Thereby, in two color printing, movement operation of the frame 6 (stencil making unit) is restrained with no waste and a first print time period from perforation to initially providing printed print sheet, can be shortened. Further, there is no drawback of erroneously setting original having different color for the operator to reading means and stencil making operation and setting operation of stencil sheet in correspondence with each of the printing drums 2A and 2B can be carried out.

Further, also in single color printing, by carrying out the set of the operator and instruction in accordance therewith, stencil making operation and setting operation of stencil sheet in correspondence with respectives of the printing drums 2A and 2B can be carried out.

Further, the frame 6 (stencil making unit) is moved to the side of the respective printing drum 2A or 2B and accordingly, a control with respect to stencil making stencil sheet S at the stencil making unit can be made uniform and the control can be simplified.

Further, although the stencil printing machine according to the above-described respective embodiment is provided with a constitution having two of the printing drums 2A and 2B, full color printing can be carried out by providing three of printing drums and carrying out stencil making and printing operation respectively arranged with colors of cyan, magenta and yellow.

Further, although according to the above-described respective embodiments, there is shown the constitution in which multiple color printing, that is, printing on one face of the print sheet is carried out by two of the printing drums 2A and 2B, the invention is not limited thereto. For example, when print sheet is reversed between the printing drum 2A and the printing drum 2B by other transfer means or when two of the printing drums 2A and 2B are made attachable and detachable and print sheet is made to pass through therebetween, there is provided a constitution for carrying out two face printing. Also in this case, stencil making and printing operation can be carried out pertinently by the above-described control.

Further, although according to the stencil printing machine according to the above-described respective embodiment, since the plurality of printing drums 2A and 2B are arranged such that respective axis lines thereof become horizontal, the frame 6 (stencil making unit) is moved in the horizontal direction. When the plurality of printing drums 2A and 2B are arranged by making the respective axis lines in parallel with each other, and, for example, on a locus in a shape of a circular arc, the frame 6 may be constituted to move in the shape of the circular arc along the locus. In this way, movement of the frame 6 (stencil making unit) is derived from the locus of arrangement constituted by the plurality of printing drums 2A and 2B.

What is claimed is:

1. A stencil printing machine comprising:

a stencil making unit for perforating stencil sheet;

a plurality of printing drums capable of setting the perforated stencil sheet;

a movement mechanism for moving the stencil making unit to the respective printing drums;

position detecting means for detecting a position of the stencil making unit;

printing drum information detecting means for detecting printing drum information with regard to the respective printing drums;

displaying means for displaying stencil making instruction information for making the stencil making unit execute a stencil making operation; and control means for making the displaying means display the stencil making instruction information capable of dealing with the printing drum information, making the stencil making unit execute the stencil making operation based on the stencil making instruction information and making the stencil making unit move.

2. The stencil printing machine according to claim 1:

wherein the stencil making unit is constituted to move to an initial position substantially at an equal distance from the respective printing drums; and wherein the control means moves the stencil making unit to the initial position after finishing to transfer the stencil sheet to the respective printing drums and making the displaying means display the stencil making instruction information for expediting the stencil making operation with regard to any of the printing drums in a successive stencil making operation.

3. The stencil printing machine according to claim 1:

wherein control means makes the stencil making unit stay on standby at a position of the printing drum to which the stencil making unit has been finally transferred after finishing to transfer the stencil sheet to the respective printing drums and makes the displaying means display the stencil making instruction information for expediting the stencil making operation with regard to the printing drum disposed at a position at which the stencil making unit is on standby in a successive stencil making operation.

* * * * *